US007001187B2

(12) United States Patent
Terunuma et al.

(10) Patent No.: US 7,001,187 B2
(45) Date of Patent: Feb. 21, 2006

(54) JUNCTION BOX AND CONNECTOR

(75) Inventors: Ichiro Terunuma, Yachiyo (JP); Atsushi Momota, Ohta (JP); Hideyuki Kosugi, Matsudo (JP); Nobumasa Misaki, Tokyo (JP)

(73) Assignee: Fujikura Ltd., Tokyo (JP)

( * ) Notice: Subject to any disclaimer, the term of this patent is extended or adjusted under 35 U.S.C. 154(b) by 71 days.

(21) Appl. No.: 10/714,608

(22) Filed: Nov. 18, 2003

(65) Prior Publication Data

US 2005/0054222 A1 Mar. 10, 2005

Related U.S. Application Data

(62) Division of application No. 10/277,746, filed on Oct. 23, 2002, now Pat. No. 6,736,648.

(30) Foreign Application Priority Data

Oct. 24, 2001 (JP) ..... 2001-326149
Oct. 24, 2001 (JP) ..... 2001-326155

(51) Int. Cl.
*H01R 12/00* (2006.01)

(52) U.S. Cl. ..... 439/76.2; 439/77

(58) Field of Classification Search ..... 439/67, 439/76.2, 77, 595, 949; 361/776, 823, 833
See application file for complete search history.

(56) References Cited

U.S. PATENT DOCUMENTS 4,689,718 A 8/1987 Maue et al.
4,767,357 A 8/1988 Hasircoglu
5,004,426 A 4/1991 Barnet
5,154,647 A * 10/1992 Ishitani et al. ..... D7/305
5,908,322 A * 6/1999 Seki ..... 439/212
5,913,689 A 6/1999 Kato
5,995,380 A * 11/1999 Maue et al. ..... 361/826
6,008,982 A * 12/1999 Smith ..... 361/624
6,224,397 B1 5/2001 Nakaura
6,261,105 B1 7/2001 Uezono
6,325,640 B1 12/2001 Kasai
6,437,986 B1 8/2002 Koshiba
6,552,274 B1 4/2003 Nakamura
6,707,689 B1 * 3/2004 Momota et al. ..... 361/833
6,736,648 B1 * 5/2004 Terunuma et al. ..... 439/76.2
2003/0076650 A1 4/2003 Momota et al.
2003/0077927 A1 4/2003 Momota et al.

FOREIGN PATENT DOCUMENTS

JP 10-243526 A 9/1998
JP 2845082 B2 10/1998
JP 11-41753 A 2/1999
JP 11-46426 A 2/1999
JP 3236802 A 9/2001

* cited by examiner

*Primary Examiner*—Thanh-Tam Le
(74) *Attorney, Agent, or Firm*—Sughrue Mion, PLLC

(57) ABSTRACT

The junction box housing of a junction box is provided with a strip portion containing portion which contains a lateral edge of a strip portion where a terminal connecting portion of a flexible printed circuit is contained in the inside and a terminal containing hole arranged at the outside of the strip-shaped portion containing portion which contains a first connecting terminal. Thus, the first connecting terminal and the strip portion can be contained in the junction box housing with the terminal connecting portion bent to show an S-shaped profile so that the junction box main body can be made lightweight and low-profiled to realize downsizing.

10 Claims, 25 Drawing Sheets

JUNCTION BOX AND CONNECTOR

This is a divisional application Ser. No. 10/277,746 filed Oct. 23, 2002 now U.S. Pat. No. 6,736,648; the disclosure of which is incorporated herein by reference.

CROSS-REFERENCE TO RELATED APPLICATIONS

This application is based upon and claims the benefit of priority from the prior Japanese Patent Applications No. 2001-326149, filed Oct. 24, 2001; and No. 2001-326155, filed Oct. 24, 2001, the entire contents of both of which are incorporated herein by reference.

BACKGROUND OF THE INVENTION

1. Field of the Invention

This invention relates to a junction box and a connector containing a connecting terminal for electrically connecting a fuse or the like to a wiring circuit. More particularly, the present invention relates to a junction box and a connector that are lightweight and low-profiled so as to promote the trend of down-sizing and allow to freely shift the point of connection with external wiring circuit, while showing a high heat emitting effect.

2. Description of the Related Art

In general, to branch a wiring of a car or the like, a junction box (J/B) has been used for purposes of space saving and cost reduction. FIG. 23 is a plan view of the junction box, FIG. 24 is a plan view of a bus bar contained in the junction box, FIG. 25 is a sectional view of a part VII of FIG. 23, and FIG. 26 is a sectional view of a part VIII of FIG. 23.

This type of a junction box 101 is constituted of a lower cover 102, a bus bar 103 attached to the lower cover 102, and an upper cover 105 which seals the lower cover and bus bar and to which a connector, fuse, and the like are attached. In the junction box 101, as shown in FIG. 24, the bus bar 103 formed, for example, of a pressed/punched metal plate of copper alloy, aluminum alloy, or the like is used to branch the wiring. Moreover, the junction box 101 also includes a function, for example, of a fuse box, when a fuse 108 is incorporated halfway in the wiring circuit constituted by the bus bar 103.

A connector 107 shown in FIG. 25 is a connector connected to the wiring circuit constituted of the bus bar 103. A connector 105*a* can be connected to the connector 107, when a connecting terminal portion 103*a* formed by bending a tip end of the bus bar 103 upwards by 90° is passed upwards through an upper cover 105 via a through hole 105*b* formed in the cover. Moreover, for a fuse attachment portion 105*c* to which a fuse 108 is attached as shown in FIG. 26, a connecting terminal portion 103*d* is formed by bending the tip end of the bus bar 103 with a slit 103*b* formed therein upwards by 90°, and is passed upwards through the upper cover 105 through a through hole 105*d* formed in-the cover. Thereby, the connecting terminal portion can directly be connected to a leg 108*a* for connecting the fuse 108, or can be connected using a so-called female to female (F—F) terminal.

Moreover, as shown in FIG. 27, the bus bars 103 and insulation plates (IP) 109 having functions of supporting and insulating the bus bars 103 are alternately superimposed to form a wiring circuit (multilayered wiring circuit) 110 which has a multilayered structure. A junction box 112 structured to contain the multilayered wiring circuit 110 in a housing for entirely protecting the outside of the circuit as shown in FIG. 28 is frequently used.

However, in the above-described junction box 101, the bus bar 103 is manufactured by punching the metal plate with a die and the wiring circuit is formed. Therefore, when the bus bars 103 having various shapes are manufactured, different dies are required, and much cost is taken. Moreover, the bus bar 103 is formed of a thick metal, a weight of the junction-box 101 therefore increases, and there is a problem that it is difficult to thin the junction box 101. Furthermore, in the junction box 112, the number of layers of the multilayered wiring circuit 110 needs to be minimized in order to prevent the weight and cost of the entire junction box from increasing. Additionally, the multilayered wiring circuit 110 having a small number of layers is used in accordance with a connection mode. For this, a circuit is drawn so as to avoid a wiring circuit of another layer and through holes 111 through which the connecting terminal portions 103*a*, 103*d* are passed, and a long circuit needs to be formed. This causes a problem that it is very difficult to lighten and thin the junction box 112.

Furthermore, since each of these junction boxes 101, 112 has a part thereof that is integral with it and on which a connector or a fuse is mounted, it inevitably shows certain dimensions and hence is subjected to certain restrictions particularly in terms of the position in a car where it is mounted. Additionally, since it has a structure in which the bus bar 103 is contained in a predetermined cabinet to make it show a rather poor heat emitting performance. Therefore, it is difficult to downsize the junction box and make is lightweight and lowly profiled particularly when it is to be used with a circuit adapted to allow a large electric current to flow. Furthermore, since the part on which a connector or a fuse is mounted is integrally formed with it, the operation of connecting the connector of an external wiring circuit to it will have to be carried out only poorly efficiently to baffle the efforts for improving the efficiency when the part, on which a fuse is mounted, is arranged on the front surface of the instrument panel of a car that is provided with a conventional junction box 101 or 112 for the purpose of improving the servicing efficiency.

BRIEF SUMMARY OF THE INVENTION

The object of the present invention is to provide a junction box and a connector that are lightweight and low-profiled so as to make themselves adapted to downsizing and show an enhanced level of freedom in terms of layout and a high heat emitting performance.

According to an aspect of the invention, the above object is achieved by providing a junction box comprising:

a junction box main body to which an electric component to be connected is attached; and a cable portion which is constituted of a flexible printed circuit with a circuit portion including a conductor pattern formed on an insulating film, and electrically connects the junction box main body to an outer wiring circuit, wherein the flexible printed circuit includes a strip portion having a part thereof contained in the junction box main body and a terminal connecting portion extending transversally from a lateral edge of the strip portion at a position to be fitted to the junction box main body, the junction box main body includes a junction box housing provided with a part fitting port for fitting the electric component and a plate-shaped first connecting terminal to be contained in the junction box housing so as to be connected to the terminal connecting portion of the flexible printed circuit and further to the electric component, the junction box housing including a strip portion containing portion for containing a strip portion provided with the terminal connecting portion of the flexible printed circuit and a terminal containing hole arranged outside the strip-shaped containing portion containing portion so as to contain the first connecting terminal with its tip end exposed to the outside, and the lateral edges of the strip portion are contained in the strip portion containing portion with the terminal connecting portion bent to show an S-shaped profile at the lateral edges of the strip-shaped containing portion of the flexible printed circuit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Now, the present invention will be described by referring to the accompanying drawings that illustrate preferred embodiments of the invention.

Figure 1:
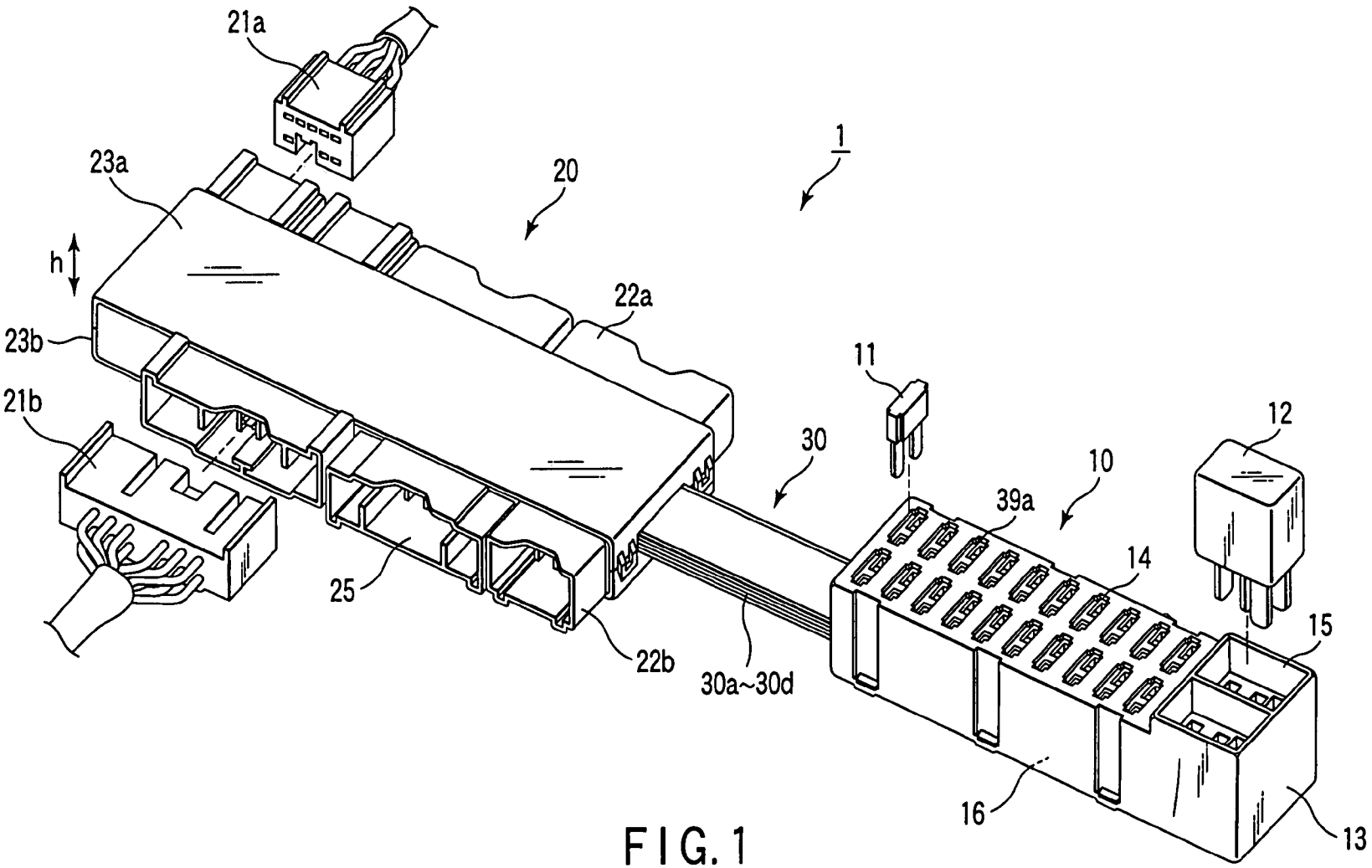
FIG. 1 is a schematic perspective view of a first embodiment of junction box and connector according to the invention.

FIG. 1 is a schematic perspective view of a first embodiment of junction box and connector according to the invention.

The junction box 1 comprises a junction box main body 10, a connector portion 20 and a cable portion 30 connecting the junction box main body 10 and the connector portion 20. The cable portion 30 is formed by laminating a plurality of strip-shaped flexible printed circuits (to be referred to as "FPCs" hereinafter) 30*a* through 30*d* in a non-bonded state and bendable manner.

The junction box main body 10 includes a junction box housing 13, which is a resin molded member, and a lid body 16 removably fitted to the housing 13 and is arranged at an end of the cable portion 30. A plurality of fuse attachment portions 14 and a plurality of relay attachment portions 15 for respectively attaching corresponding fuses 11 and relays 12 are formed in two rows in the longitudinal direction of the cable portion 30 on the surface the junction box housing 13

(that corresponds to the front surface of the junction box), which is same as the main surface of the group of FPCs 30*a* through 30*d*.

The connector portion 20 comprises connector housings 22*a*, 22*b*, which are resin molded members, and case portions 23*a*, 23*b* adapted to partly contain the connector housings 22*a*, 22*b* and can be divided in a thickness direction of the cable portion 30 and is arranged at the opposite end of the cable portion 30. The connector housings 22*a*, 22*b* include a plurality of connector engagement portions 25 into which respective plug connectors 21*a*, 21*b* are inserted.

Figure 2:
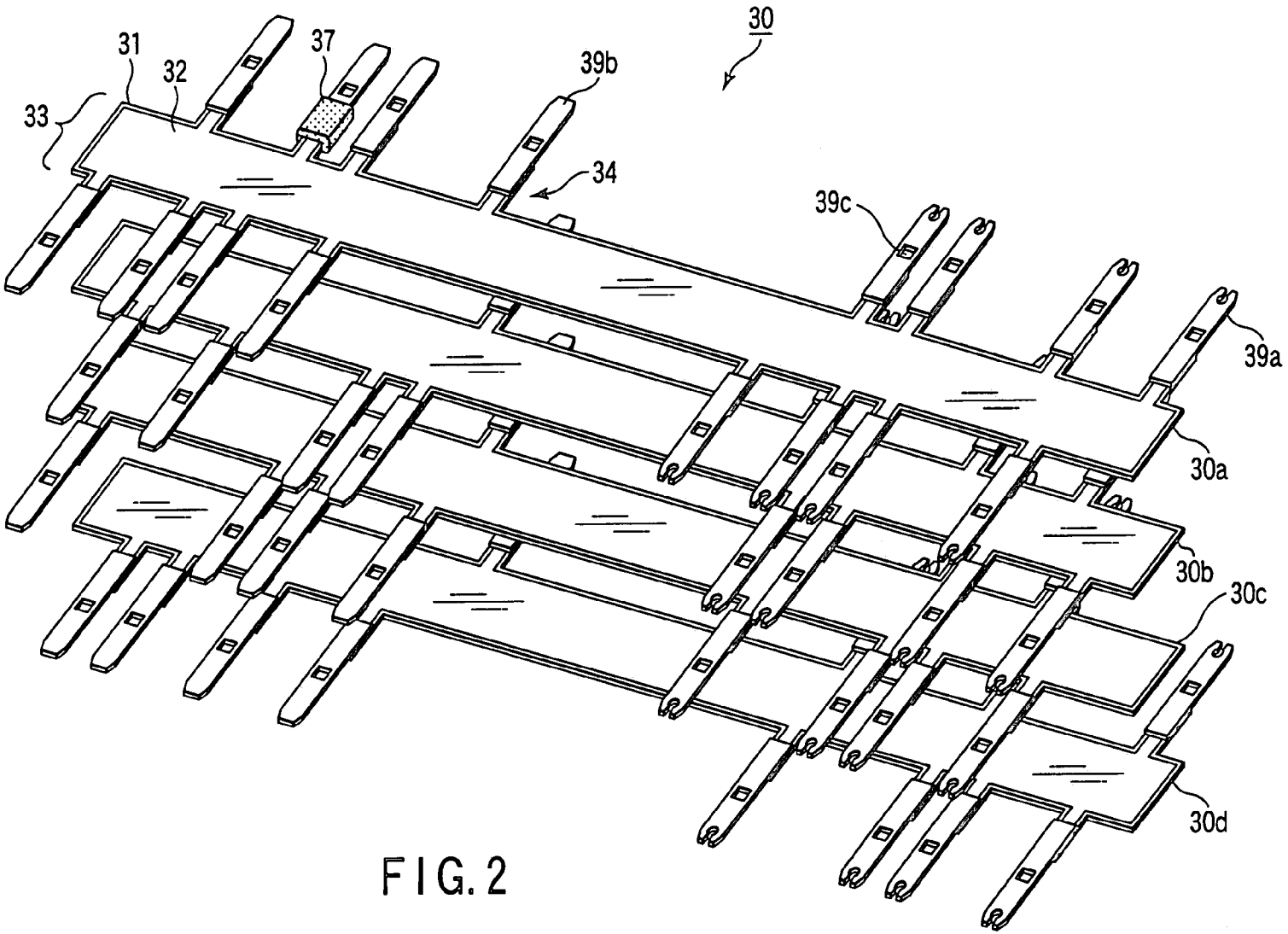
FIG. 2 is an exploded schematic perspective view of the cable portion.

FIG. 2 is an exploded schematic perspective view of the cable portion 30. While the cable portion 30 may be made to have a single FPC, superimposed upon one another in non-bonded state a plurality of FPCs in this embodiment.

Each of the FPCs 30*a*, 30*b*, 30*c*, 30*d* of the cable portion 30 comprises a circuit portion 32 produced by forming a pattern of a conductor material such as copper foil on a base film 31 typically made of insulating film of polyethyleneterephthalate (PET), polyethylenenaphthalate (PEN), polyimide (PI) or the like. If necessary, the circuit portion 32 is protected by a cover layer (not shown).

Each of the FPCs 30*a* through 30*d* is provided at the lateral edges of the strip portion 33 thereof with a plurality of terminal connecting portions 34 having a predetermined length and extending transversally. The tip end of each of the terminal connecting portions 34 is connected to a metal-made and plate-shaped first connecting terminal 39*a* contained in the junction box housing 13 and constituting a part of the junction box main body 10 or a second connecting terminal 39*b* contained in the connection housing 22*a* (or 22*b*) and constituting a part of the connector portion 20. In this embodiment, the first connecting terminal 39*a* is a so-called fork terminal to be connected to fuses 11 and relays 12, while the second connecting terminal 39*b* is a so-called male connecting terminal to be connected to a female connecting terminal (not shown) of-the plug connector 21*a* or 21*b*. Alternatively, the terminal connecting portions 34 may be arranged only at one of the lateral edges of the strip portions 33. The first and second connecting terminals 39*a*, 39*b* are provided with respective engagement holes 39*c* that are to be engaged respectively with lance mechanisms disposed in the junction box housing 13 and the connector housings 22*a* (or 22*b*) as will be described greater detail hereinafter.

The first and second connecting terminals 39*a*, 39*b* are mounted respectively on the corresponding terminal connecting portions 34 so as to tightly adhere to the circuit portions 32 arranged on the terminal connecting portions 34 and bonded to the circuit portions 32 typically by means of resistance welding and hence to the terminal portions 34. After connecting the first and second connecting terminals 39*a*, 39*b* to the terminal connecting portion 34, the FPCs 30*a* through 30*d* are laid one on the other to produce a complete cable portion 30. Note that the terminal connecting portions 34 of the FPCs 30*a* through 30*d* are arranged in such a way that the first and second connecting terminals 39*a*, 39*b* are located at positions that properly correspond to the positional arrangement for connecting terminals of the junction box housing 13 and the connector housings 22*a* (22*b*).

After forming the cable portion 30 by laying the strip-shaped FPCs 30*a* through 30*d*, a resin molded portion 37 is formed and sealed by molding hot melt resin for the bonding portion of each of the connecting terminals 39*a* (39*b*) and the bonding portion of the corresponding connecting terminal portion 34 to improve the reliability of the connection of the bonding portions. Then, the first connecting terminals 39*a* are fitted to the junction box housing 13 while the second connecting terminals 39*b* are fitted to the connector housings 22*a* (22*b*). The terminal connecting portions 34 connected to the first connecting terminals 39*a* may be bent in such a way that the first connecting terminals 39*a* are housed in respective right terminal positions in the junction box housing 13, while they extend perpendicularly relative to the surface where the circuit portion 32 is formed in the cable portion 30. The terminal connecting portions 34 connected to the second connecting terminals 39*b* may not be bent at all.

Figure 3:
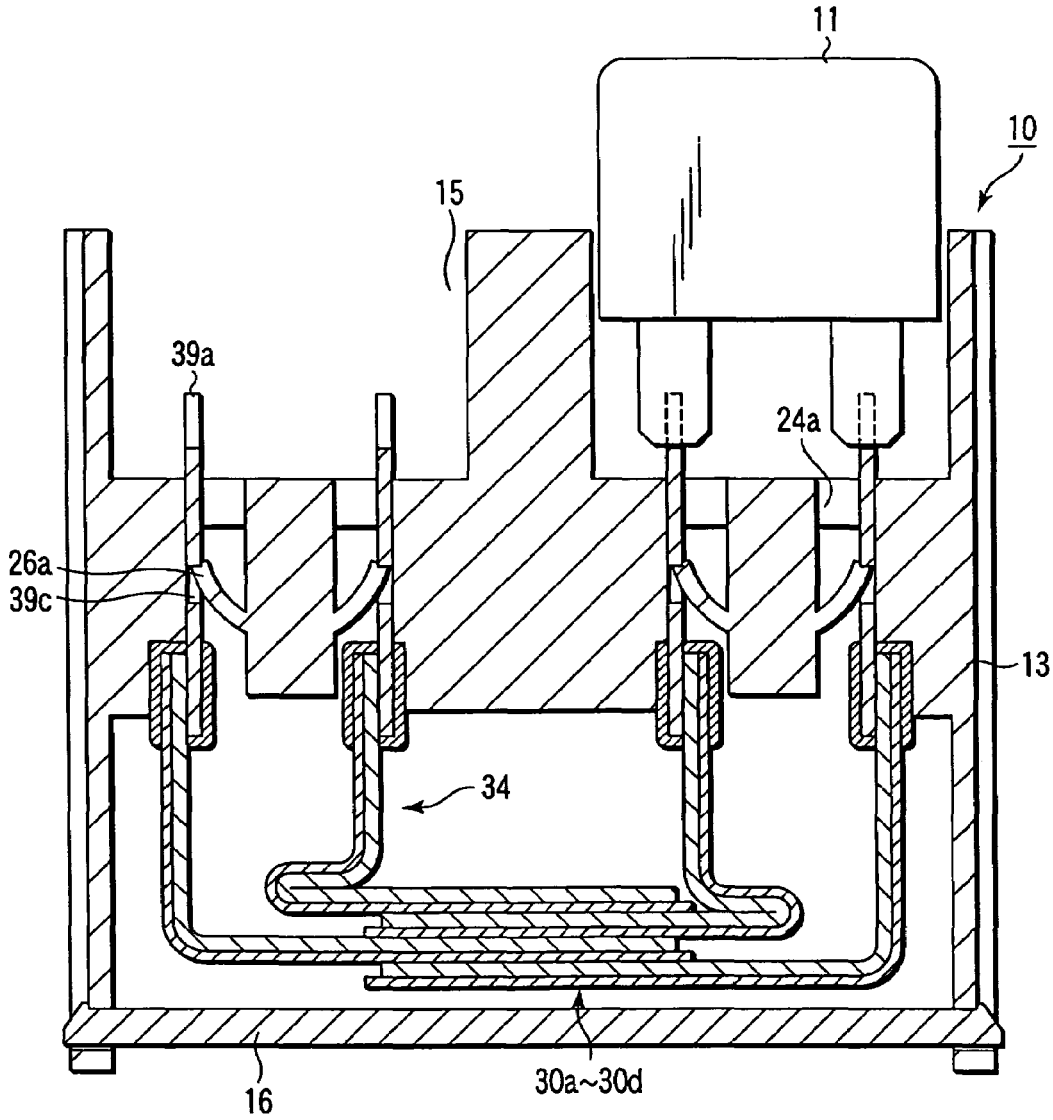
FIG. 3 is a schematic partial cross sectional view of the junction box main body where the first connecting terminals are fitted to one of the junction box housings.
Figure 4:
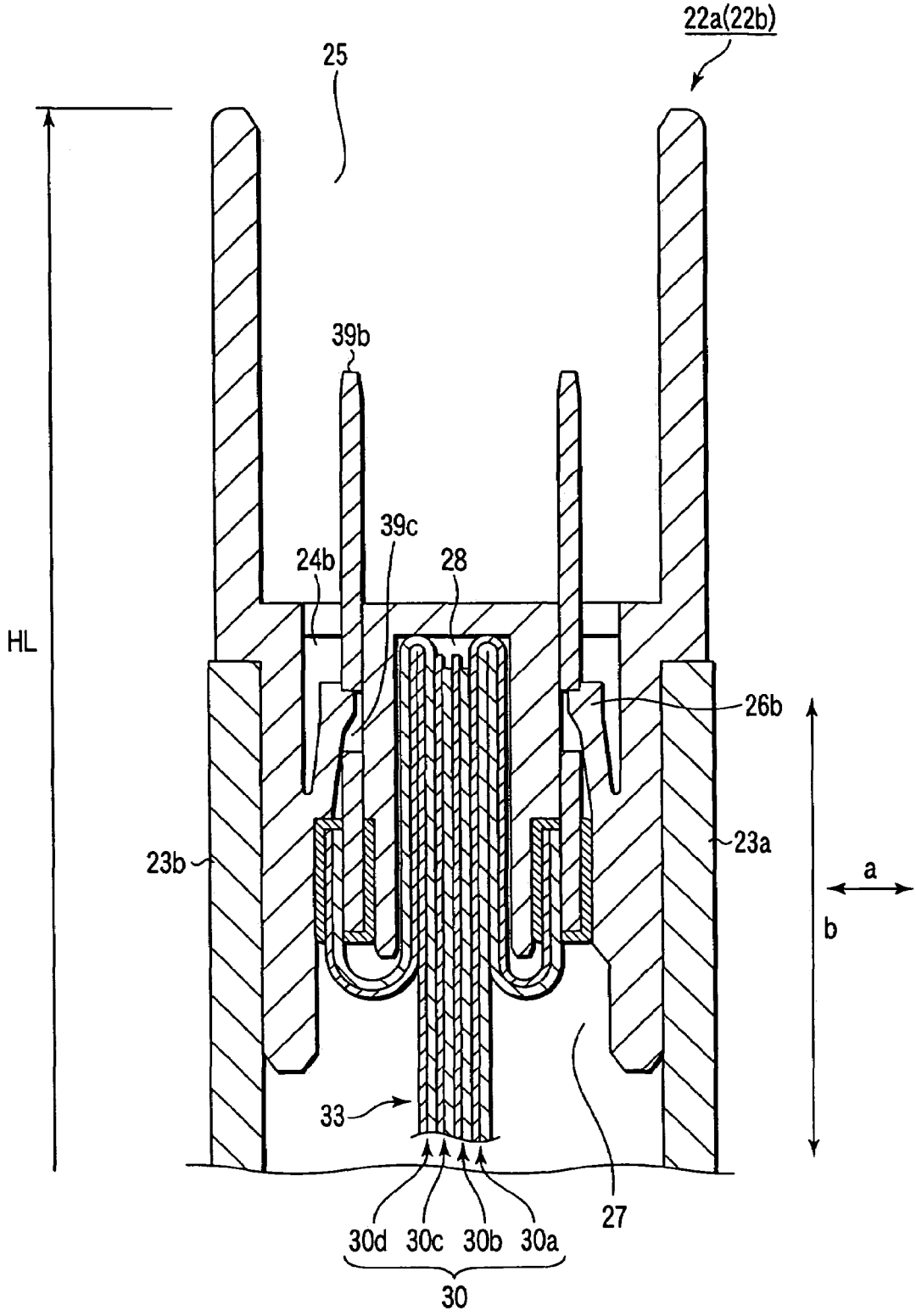
FIG. 4 is a schematic partial cross sectional view of the connector portion where the second connecting terminals and the strip portion are fitted to one of the connector housings.

FIG. 3 is a schematic partial cross sectional view of the junction box main body 10 where the first connecting terminals 39*a* are fitted to the junction box housing 13. FIG. 4 is a schematic partial cross sectional view of the connector portion 20 where the second connecting terminals 39*b* and the strip portion 33 are fitted to the connector housing 22*a* (or 22*b*).

As shown in FIG. 3, the junction box housing 13 of the junction box main body 10 has a plurality of terminal containing holes 24*a*, or terminal containing portions, for respectively containing the first connecting terminals 39*a* that are inserted into it with the exposed tip ends thereof and lance portions 26*a*, or lance mechanisms, to be engaged respectively with the engagement holes 39*c* of the first connecting terminals 39*a* so as to rigidly secure the first connecting terminals 39*a* in the junction box housing 13. The terminal containing holes 24*a* and the lance portions 26*a* are arranged respectively at predetermined positions. The FPCs 30*a* through 30*d* of the cable portion 30 are contained in the junction box housing 13 with the surfaces thereof that form the circuit portions 32 arranged flat and the terminal connecting portion 34 bent in a perpendicular direction.

On the other hand, as shown in FIG. 4, the connector housing 22*a* (22*b*) of the connector portion (not shown) is provided with a connector engagement portion 25 for receiving connectors (not shown) of outer wiring circuits and the plug connector 21*a* (21*b*), a plurality of terminal containing holes 24*b* for respectively containing the second connecting terminals 39*b* that are inserted into it with the tip ends thereof projecting into the connector engagement portion 25, a strip-shaped portion containing portion 28 for receiving the FPCs 30*a* through 30*d* of the cable portion 30 in the direction of the lateral edges of the strip portion 33 with the terminal connecting portions 34 bent to show an S-shape profile and connected to the second connecting terminals 39*b* inserted into and contained in the respective terminal containing holes 24*b* and insertion holes 27 for receiving the second connecting terminals 39*b* and the cable portion 30 so as to insert them into the connector housing 22*a* (22*b*). In each of the terminal containing holes 24*b* (and hence outside the strip-shaped portion containing portion 28), a lance portion 26*b*, or a lance mechanism, to be engaged with the engagement hole 39*c* of the corresponding second connecting terminal 39*b* and rigidly securing the second connecting terminal 39*b* in the connector housing 22*a* (22*b*) is formed so as to extend from the inner wall side of the corresponding insertion hole 27 toward the inside.

The strip portions 33 of the FPCs 30*a* through 30*d* of the cable portion 30 are mostly contained within the connector housing 22*a* (22*b*) in such a way that the transversal direction a of the connector housing 22*a* (22*b*) rectangularly intersects the transversal direction b of the strip portions 33 of the cable portion 30. With this arrangement, the length HL that includes the length of the connector housing 22*a* (22*b*) and the width of the cable portion 30 can be minimized. A complete junction box 1 as shown in FIG. 1 is produced by fitting the cable portion 30 to the housings 13 and 22*a* (22*b*) and subsequently fitting the lid body 16 and the case portion 23 to the housings.

Figure 5:
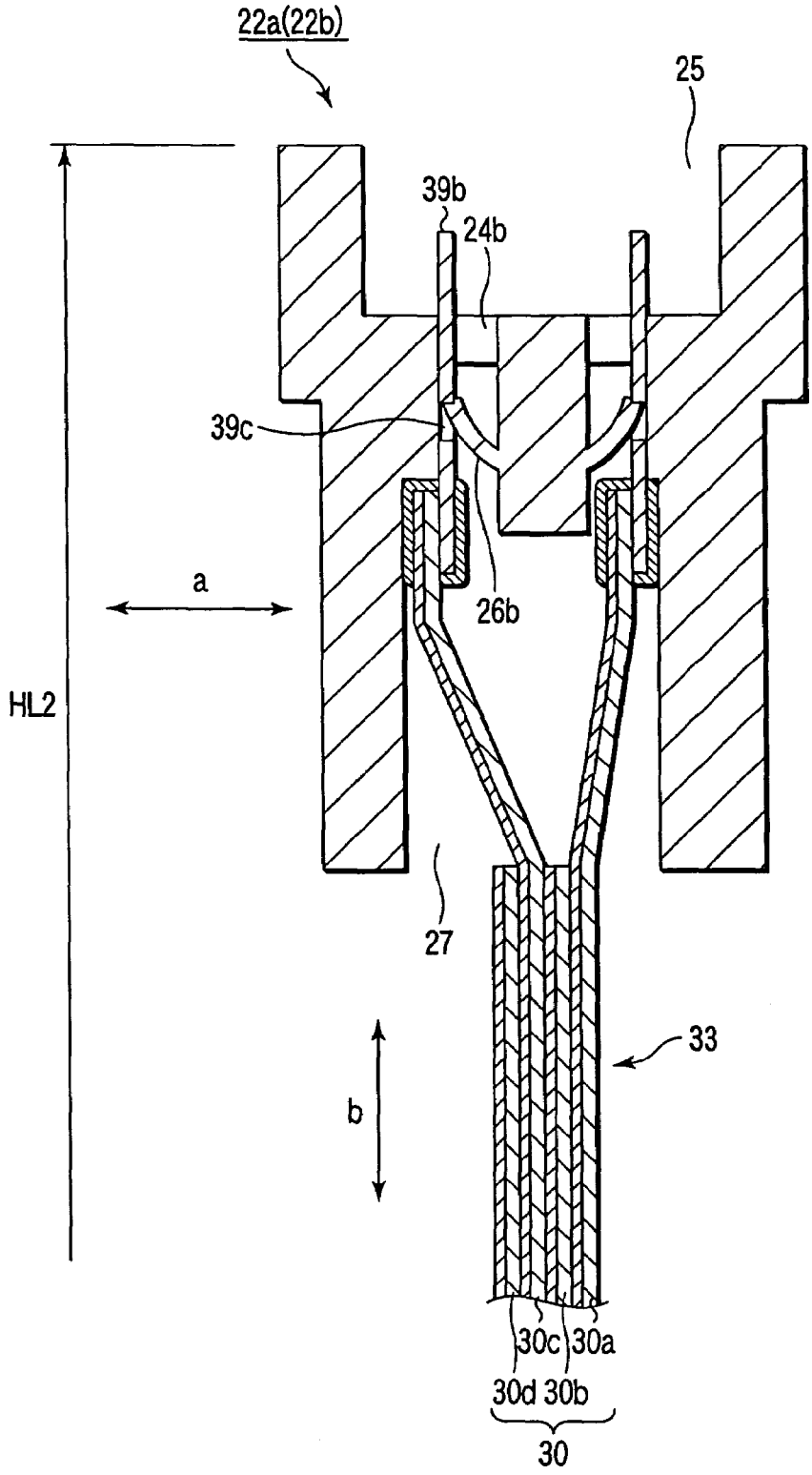
FIG. 5 is a schematic partial cross sectional view of one of the connector housings to which second connecting terminals are fitted.

A connector housing 22*a* (22*b*) having connector engagement portions 25, terminal containing holes 24*b*, lance portions 26*b* and insertion holes 37 as shown in FIG. 5 may alternatively be used so that the strip portions 33 of the FPCs 30*a* through 30*d* of the cable portion 30 may not be mostly contained within the connector housing 22*a* (22*b*). If such is the case, while the length HL is replaced by a longer length HL2 that is equal to the sum of the length of the connector housing 22*a* (22*b*) and the width of the cable portion 30, the connector portion 20 will still be satisfactorily downsized as it is sufficiently lightweight and low-profiled. Still alternatively, the junction box housing 13 may be made same as the connector-housing 22*a* (22*b*) and the terminal connecting portions 34 of the cable portion 30 may be bent to show an S-shape profile to contain the strip portion 33 in a strip-shaped portion containing portion 28 formed in the junction box housing 13, although not shown in the drawing.

The first connecting terminals 39*a* and the second connecting terminals 39*b* can be made to conform to the profile of the junction box 1 by bending the terminal-connecting portions 34 in a desired manner and shifting the positional arrangement of the connecting terminals 39*a*, 39*b* to a great advantage of improving the degree of design freedom. Then, it is possible to extremely reduce the height of the connector portion 20 shown in FIG. 1 if compared with conventional junction boxes to remarkably reduce the required space.

Figure 6:
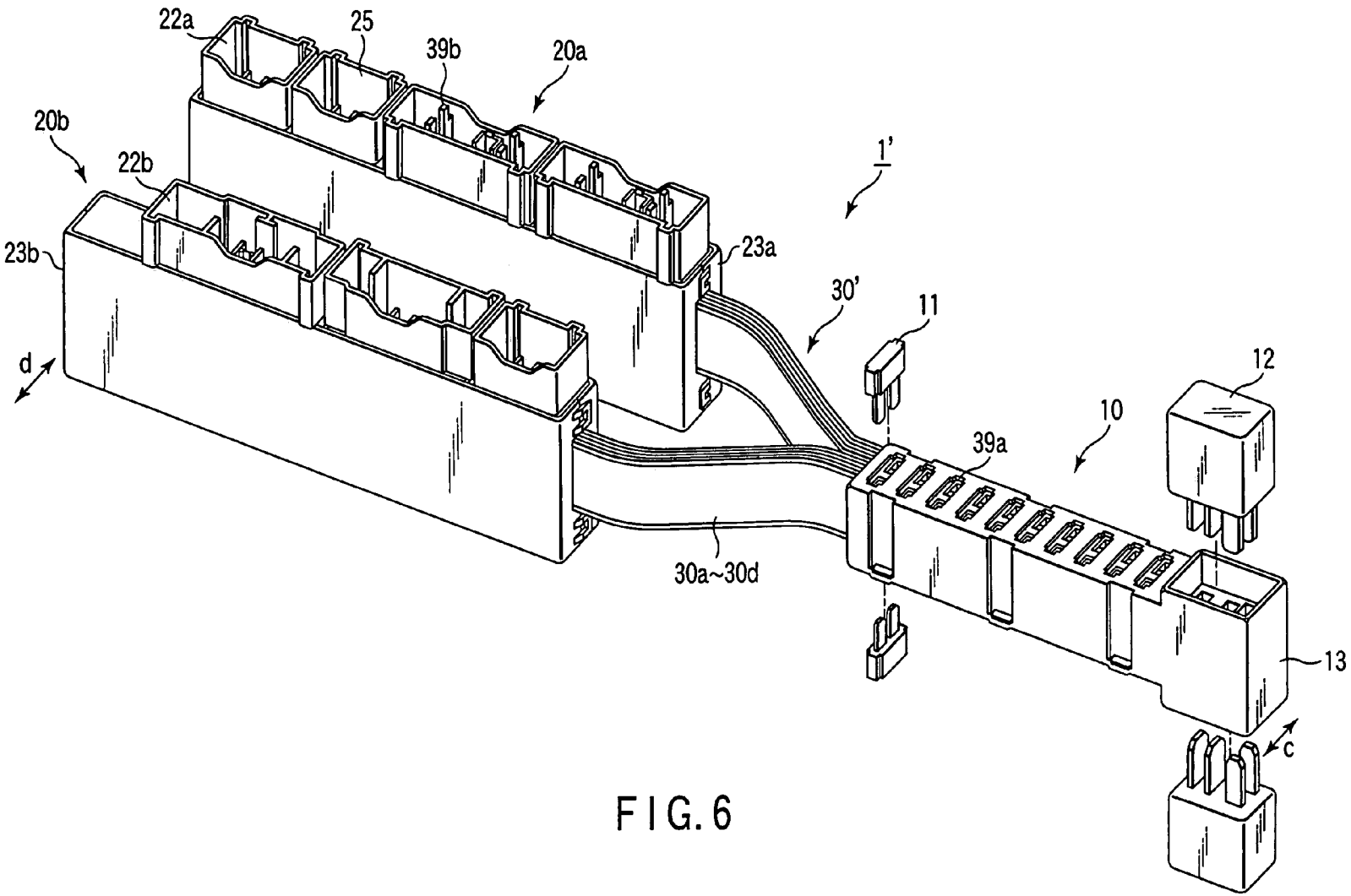
FIG. 6 is a schematic perspective view of another embodiment of junction box and connector according to the invention.

FIG. 6 is a perspective view showing the appearance of another junction box and connector according to the embodiment of the present invention.

A junction box 1' of this example is different from the junction box 1 according to the above-described embodiment in that a cable portion 30' is branched into two in a superimposition direction of the FPCs 30*a* to 30*d*, two connector portions 20*a*, 20*b* are disposed on branched ends, and the fuse attachment portion 14 and relay attachment portion 15 of a junction box main body 10' are inserted into opposite side edges of the cable portion 30' from opposite sides in each row. In the embodiment, each of the connector portions 20*a*, 20*b* includes the connector engagement portion 25 only in one side edge of the cable portion 30'.

FIGS. 7A to 11B are diagrams showing the constitution of the cable portion 30' of this example.

Figure 7A:
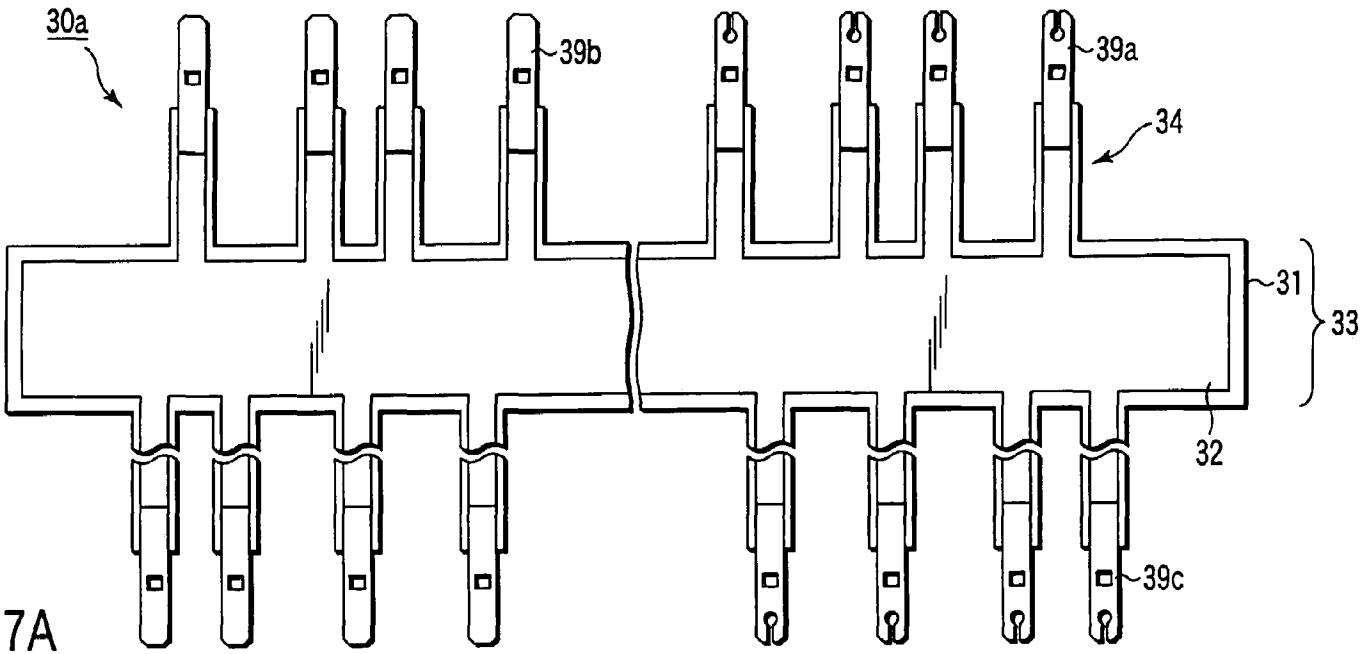
FIGS. 7A and 7B are schematic illustrations of the cable portion of the junction box of FIG. 6, showing its configuration.

First, as shown in FIG. 7A, the strip FPC 30*a* constituting a part of the cable portion 30' is constituted by disposing the patterned/formed circuit portion 32 on the base film 31 formed of the insulating film such as PET, PEN and PI. Additionally, as not shown, the cover layer is formed on the constitution if necessary. A plurality of terminal connecting portions 34 are formed to extend in the short direction of the strip portion 33 by the desired length from opposite side edges of the strip portion 33 of the FPC 30*a*. For example, first and second connecting terminals 39*a*, 39*b* having metal plate shapes are connected to the tip ends of the terminal connecting portions 34. In this example, the terminal connecting portions 34 on one side are formed to be longer than the terminal connecting portions 34 on the other side. Additionally, the terminal connecting portions 34 may also be formed only on one side edge of the strip portion 33. Moreover, in the first and second connecting terminals 39*a*, 39*b*, the engagement holes 39*c* engaged with the lance mechanism disposed, for example, in a junction box housing 13*a* (13*b*) or the connector housing 22*a* (22*b*) are formed.

Figure 7B:
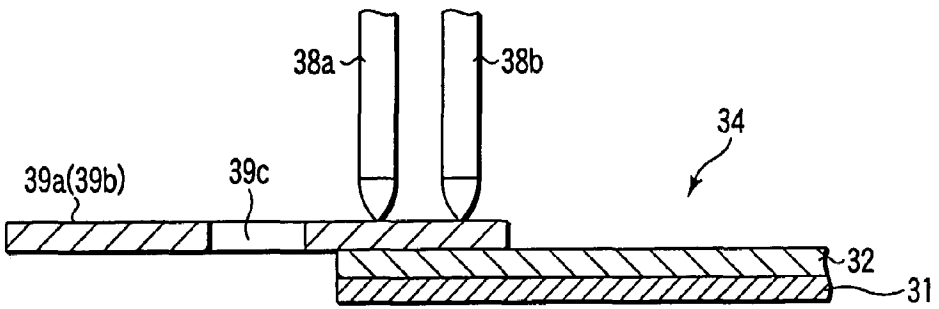

As shown in FIG. 7B, each connecting terminal 39*a* (39*b*) is disposed on the terminal connecting portion 34 so as to adhere to the circuit portion 32 on the terminal connecting portion 34. Thereafter, the terminal is subjected to the resistance welding by a pair of electrodes 38*a*, 38*b* of a series welding apparatus (not shown) allowed to abut on the terminal from above the connected portion with the circuit portion 32, bonded to the circuit portion 32 and connected to the terminal connecting portion 34. Additionally, since the resistance welding is a known technique, the description thereof is omitted. Additionally, the connecting terminal 39*a* (39*b*) may also be connected to the terminal connecting portion 34 by other methods such as ultrasonic welding, laser welding and soldering. When the terminals are connected to the portions in these connection methods, a high connection reliability can be secured.

Figure 8A:
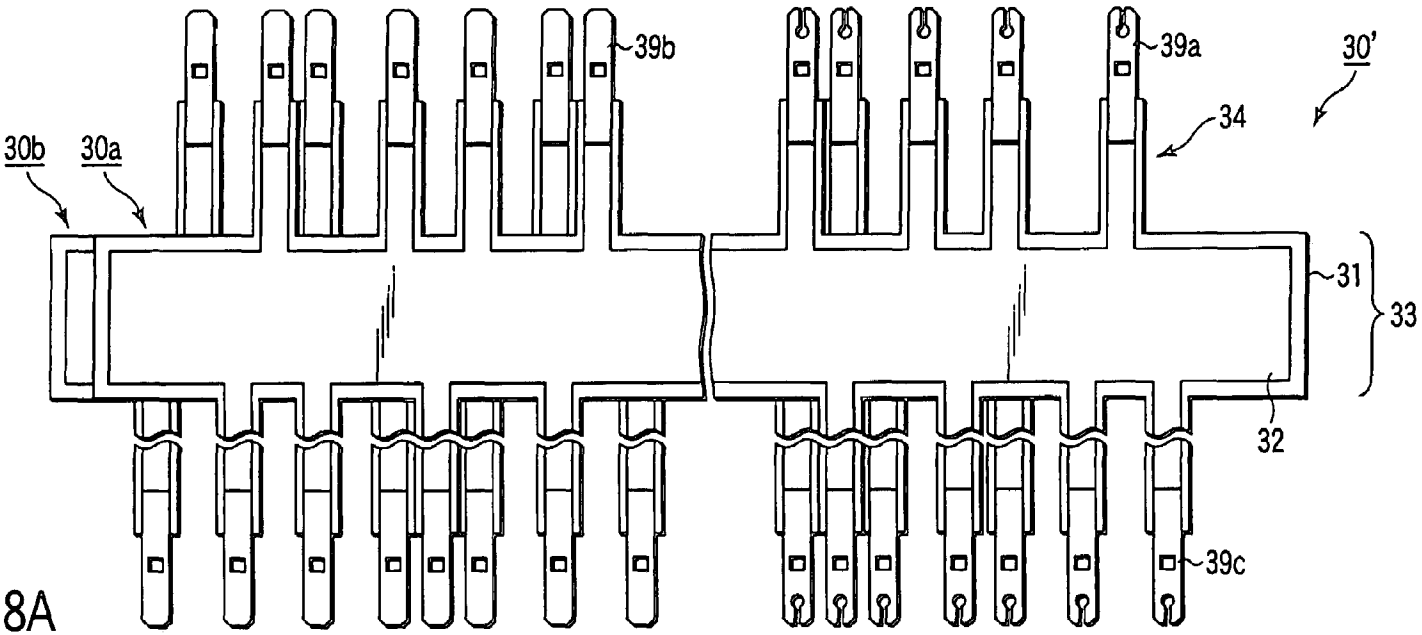
FIGS. 8A through 8C are also schematic illustrations of the cable portion of the junction box of FIG. 6, showing its configuration.
Figure 8C:
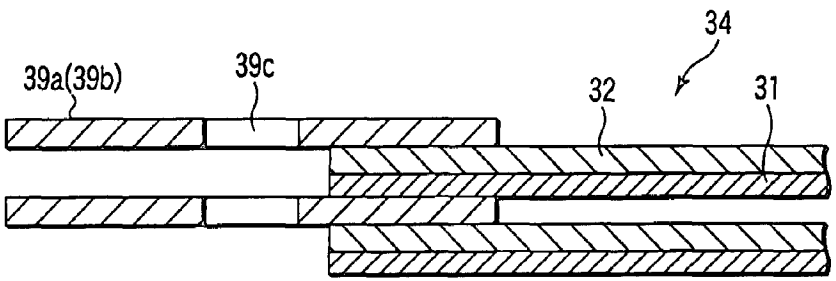
Figure 8B:
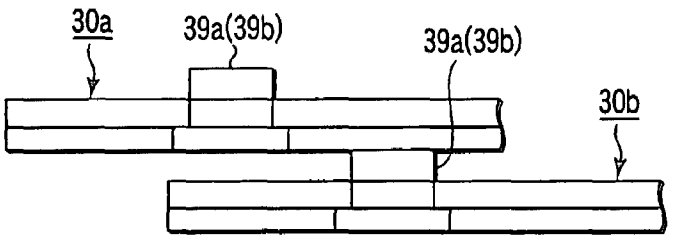

Subsequently, as shown in FIGS. 8A and 8B, the strip FPC 30*a* (30*b*) formed by connecting the connecting terminals 39*a* (39*b*) to the terminal connecting portions 34 in the method is superimposed to constitute the cable portion 30'. FIG. 8A is a top plan view showing the cable portion 30' constituted by superimposing the FPCs 30*a*, 30*b* upon each other, FIG. 8B is a partial side view of the cable portion 30', and FIG. 8C is a partial sectional view of the cable portion 30'. In this case, the terminal connecting portions 34 constituting the FPCs 30*a*, 30*b* constituting the cable portion 30' may be disposed and formed in the desired positions of the side edges of the strip portion 33 so that the connecting terminal 39*a* (39*b*) is disposed in a predetermined position corresponding to the connecting terminal arrangement position of the junction box housing 13*a* (13*b*) or the connector housing 22*a* (22*b*).

Figure 9A:
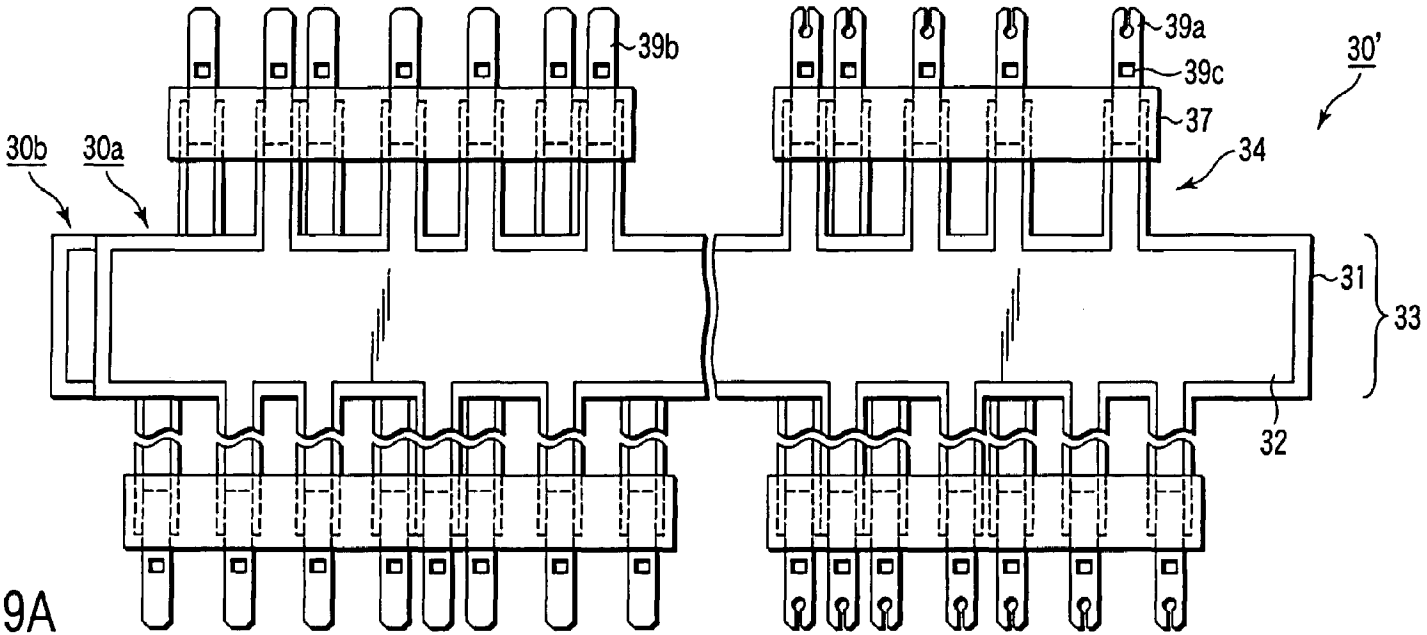
FIGS. 9A through 9C are also schematic illustrations of the cable portion of the junction box of FIG. 6, showing its configuration.
Figure 9B:
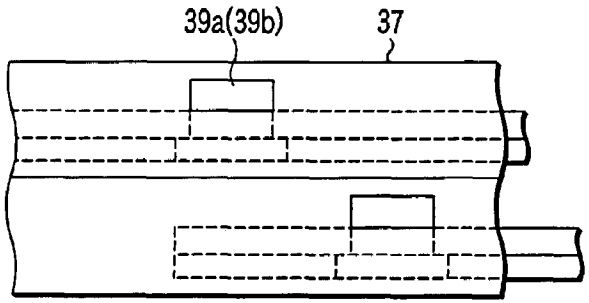
Figure 9C:
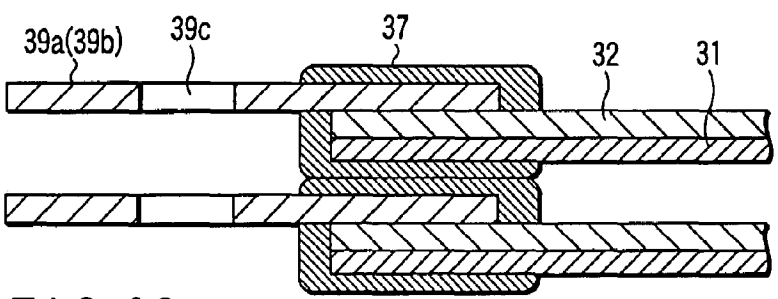

After a plurality of FPCs 30*a*, 30*b* are superimposed to form the cable portion 30' in this manner, as shown in FIGS. 9A to 9C, the connected portion of each connecting terminal 39*a* (39*b*) to the terminal connecting portion 34 is sealed by the resin molded portion 37. In this case, a certain number of connecting portions are collectively resin-molded at once as shown in FIG. 9A, the desired terminal arrangement state of the connecting terminals 39*a* (39*b*) can be realized without separating bonding the strip portions 33 of the FPCs 30*a*, 30*b* having the non-bonded states. Moreover, since the strip portions 33 of the FPCs 30*a*, 30*b* are not attached, it is possible to flexibly move the respective FPCs 30*a*, 30*b*. FIG. 9A is a top plan view showing the cable portion 30' to which the resin mold is applied, FIG. 9B is a partial side view of the cable portion 30', and FIG. 9C is a partial sectional view of the cable portion 30'.

Figure 10A:
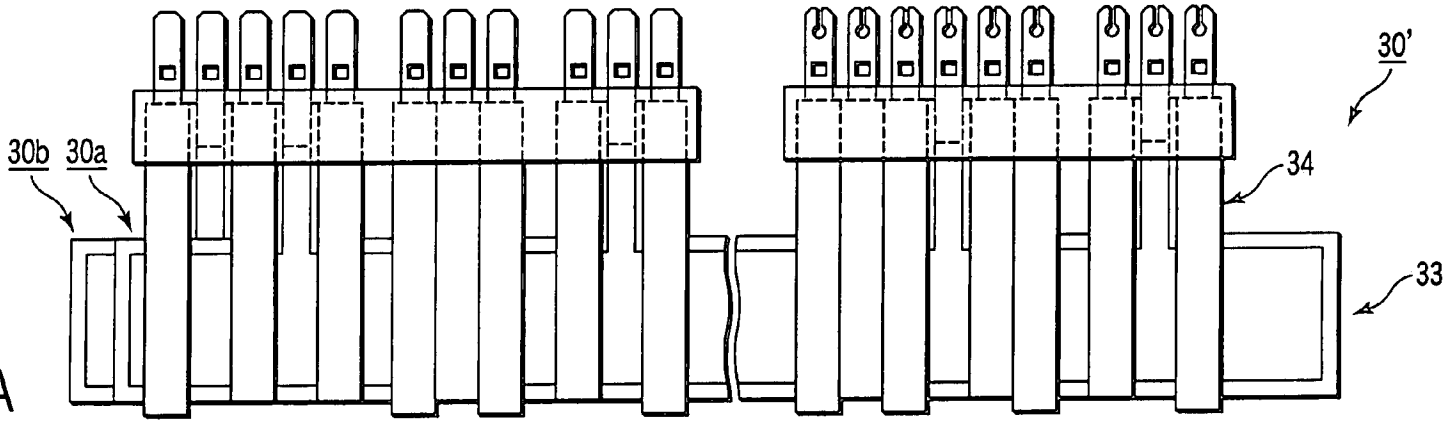
FIGS. 10A and 10B are also schematic illustrations of the cable portion of the junction box of FIG. 6, showing its configuration.
Figure 10B:
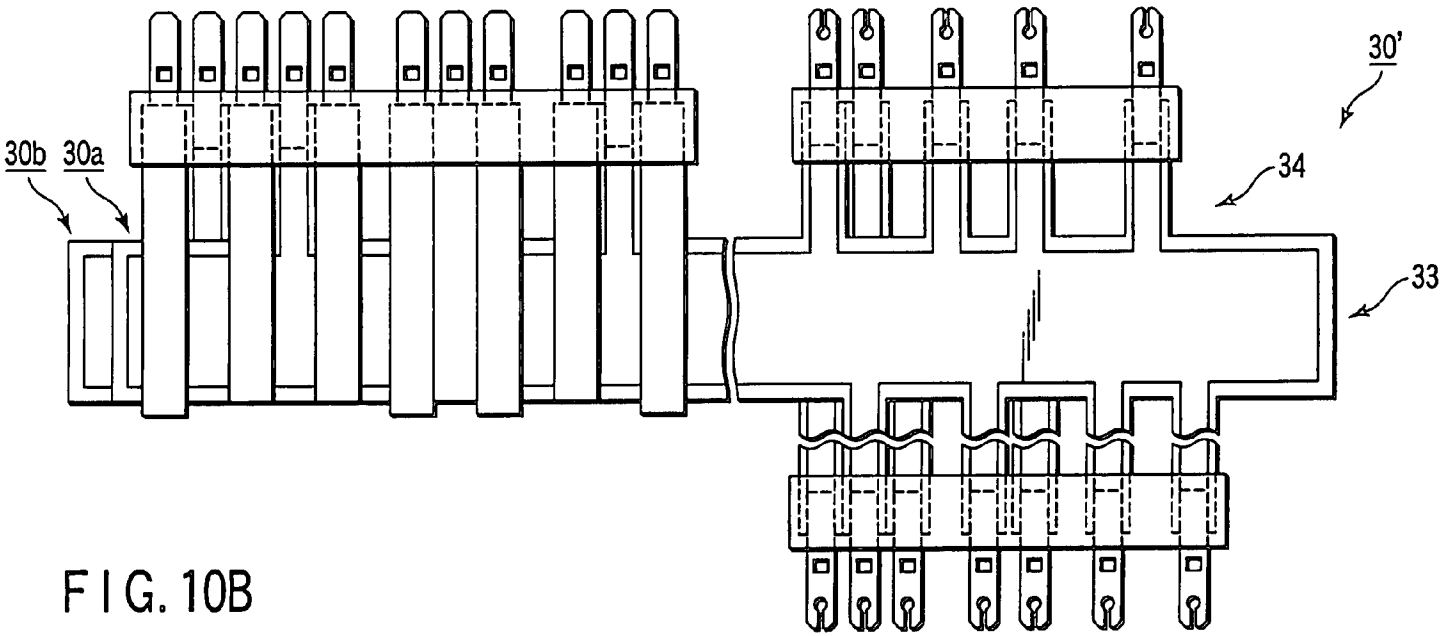

Additionally, as shown in FIG. 10A, for example, the terminal connecting portions 34 formed on one side edge of the strip portion 33 of the cable portion 30' formed in this manner are folded back on the side of the terminal connecting portions 34 formed in the other side edge. The terminal connecting portions 34 and connecting terminals 39*a* (39*b*) may also be disposed on one side edge of the cable portion 30' in a concentrated manner. As shown in FIG. 10B, for example, only the terminal connecting portions 34 formed on one side edge of the cable portion 30' to be contained in the connector portion 20*a* (20*b*) of the cable portion 30' may also be folded back toward the terminal connecting portions 34 formed on the other side edge to constitute the cable portion 30'. When the terminal connecting portions 34 and connecting terminals 39*a* (39*b*) are arranged on one side edge, the entire height and width of the junction box can be suppressed. When only some of the terminal connecting portions 34 and connecting terminals 39*a* (39*b*) are disposed on one side edge, as in the junction box 1' of this example, the height of one structure of the junction box main body 10' or the connector portion 20*a* (20*b*) is suppressed, and the connection is possible from an upward/downward direction in the other structure. Moreover, when the cable portion 30' in the state shown in FIGS. 8A and 8B is used, a width c of the junction box main body 10 and a width d of the connector portion 20*a* (20*b*) are reduced. In this case, a structure in which the connection from the upward/downward direction is possible both in the junction-box main body and connector portion can be realized.

Figure 11:
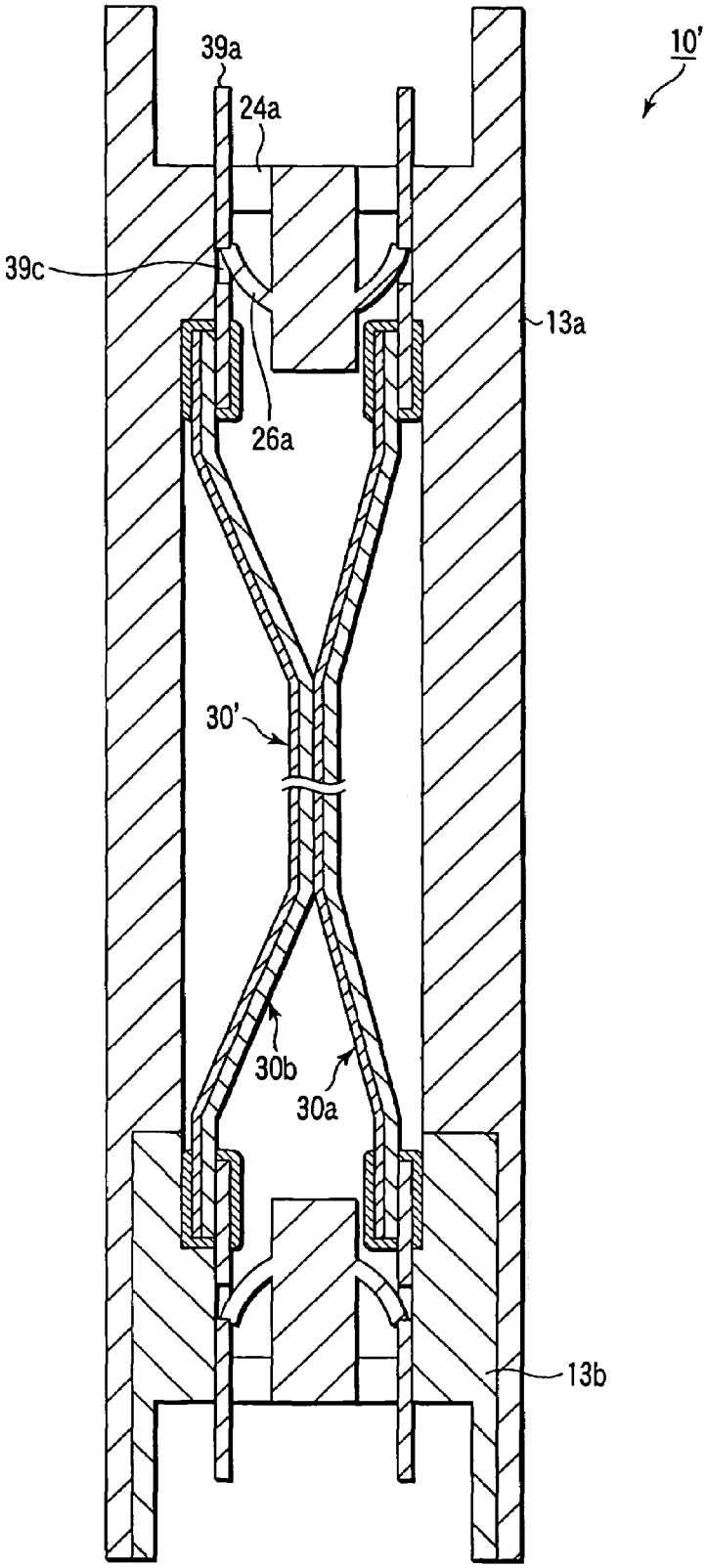
FIG. 11 is a schematic partial cross sectional view of the junction box housing to which first connecting terminals are fitted.
Figure 12:
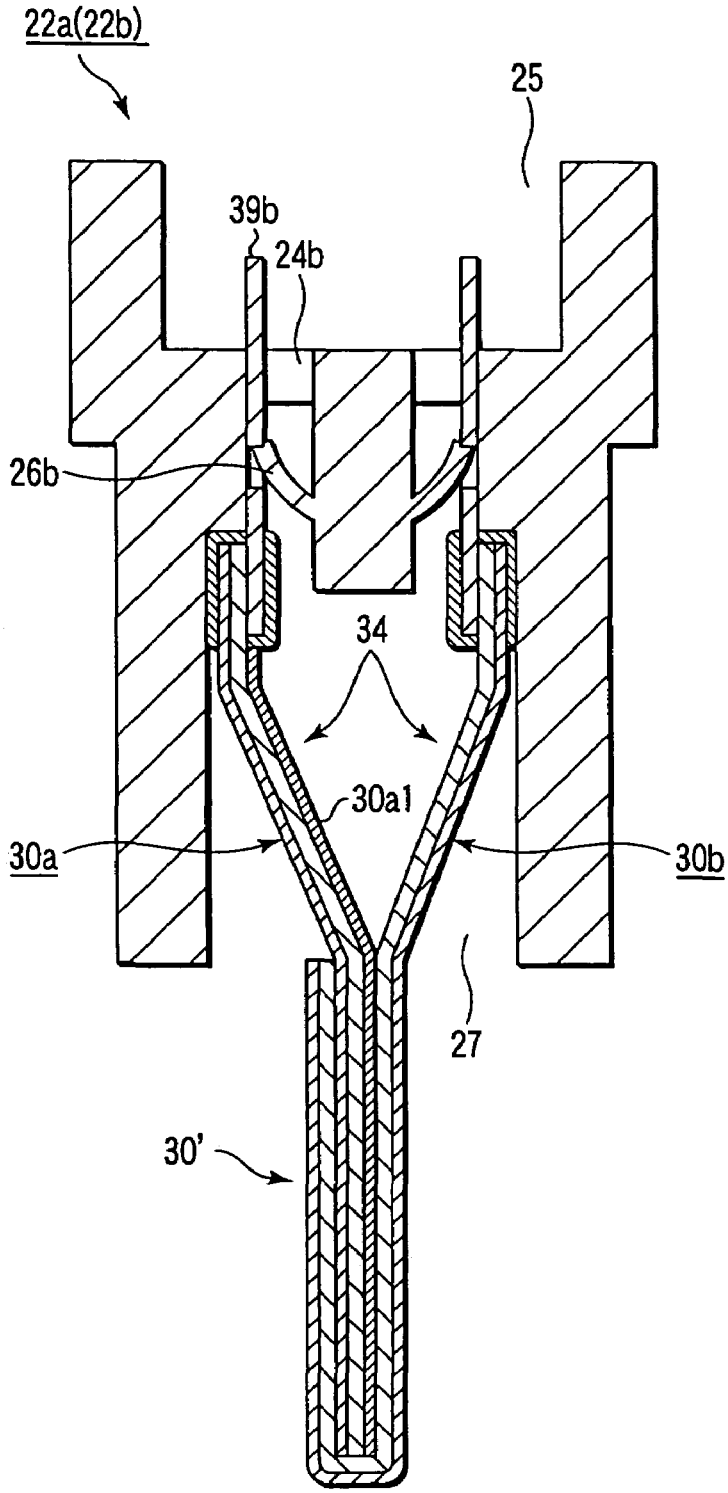
FIG. 12 is a schematic partial cross sectional view of the one of the connector housings to which second connecting terminals are fitted.

FIG. 11 is a partially sectional view showing that the first connecting terminals are attached to the junction box housings 13*a,* 13*b* of the junction box main body 10', and FIG. 12 is a partially sectional view showing that the second connecting terminals 39*b* are attached to the connector housing 22*a* (22*b*) of the connector portion 20*a* (20*b*).

As shown in FIG. 11, in the junction box housing 13*a* (13*b*) of the junction box main body 10', the terminal containing holes 24*a* through which the first connecting terminals 39*a* are passed and in which the terminals having tip ends exposed are contained, and the lance portions 26*a* as the lance mechanism which are engaged with the engagement holes 39*c* of the first connecting terminals 39*a* and lock/fix the first connecting terminals 39*a* in both the junction box housings 13*a,* 13*b* are formed in the predetermined positions. The junction box housings 13*a,* 13*b* are locked by a lock mechanism (not shown). When the mechanism is unlocked, the housings can be vertically divided in the structure. The FPCs 30*a,* 30*b* constituting the cable portion 30' are contained in the junction box housings 13*a,* 13*b* while the surfaces with the circuit portions 32 formed thereon are longitudinally disposed and the terminal connecting portions 34 are extended as such from the opposite side edges.

On the other hand, as shown in FIG. 12, in the connector housing 22*a* (22*b*), there are formed: the connector engagement portion 25 which is engaged with the connector of the outer wiring circuit; a plurality of terminal containing holes 24*b* through which the second connecting terminals 39*b* are passed and in which the terminals having the tip ends projected in the connector engagement portion 25 are contained; and the insertion hole 27 into which the cable portion 30' having the second connecting terminals 39*b* passed through the terminal containing holes 24*b* is inserted in the side edge direction of the strip portion 33. In a plurality of terminal containing holes 24*b,* the lance portions 26*b,* engaged with the engagement holes 39*c* of the second connecting terminals 39*b,* for locking/fixing the second connecting terminals 39*b* in the connector housing 22*a* (22*b*) are formed. The terminal connecting portions 34 of the FPCs 30*a,* 30*b* constituting the cable portion 30' are contained in the insertion hole 27 in the connector housing 22*a* (22*b*) so that the terminal connecting portions constitute the predetermined connecting terminal arrangement positions in a state shown in FIG. 12. Additionally, since a cover layer 30*a*1 is disposed on the circuit portion 32 of the FPC 30*a,* the circuit portion is structured not to have a short circuit with the circuit portion 32 of the folded-back terminal connecting portion 34 of the FPC 30*b.*

Figure 13B:
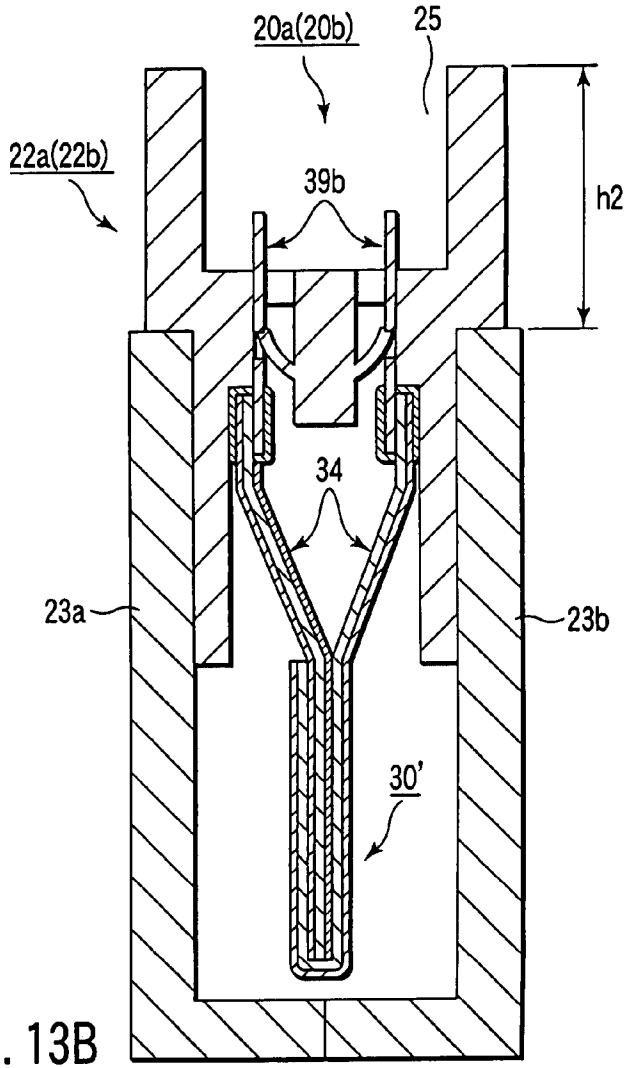
FIGS. 13A and 13B are schematic illustrations of two alternative connector housings having different profiles, showing the connector portion in partial cross section.
Figure 13A:
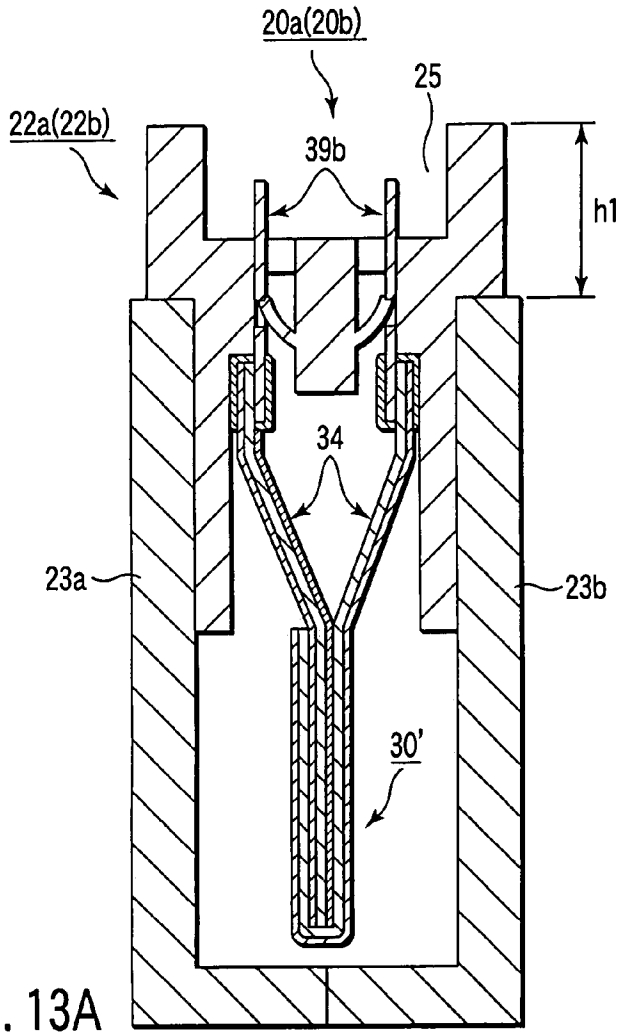

With the above-described attachment structure of the connecting terminal 39*b* to the connector housing 22*a* (22*b*), as shown in FIGS. 13A and 13B, when the connector housing 22*a* (22*b*) is just replaced with a housing having a different shape, the connector portion 20*a* (20*b*) can inexpensively be realized in accordance with various connector shapes. For example, a height h1 of an outer wall constituting the connector engagement portion 25 of the connector housing 22*a* (22*b*) shown in FIG. 13A is different from a height h2 of the outer wall constituting the connector engagement portion 25 of the connector housing 22*a* (22*b*) shown in FIG. 13B. Therefore, without changing the folded-back modes of the connecting terminals 39*b* and terminal connecting portions 34, cable portion 30' and case portion 23*a* (23*b*), it is possible to connect the connectors (outer connector's) of different types of outer wiring circuits, plug connectors 21*a,* 21*b,* and the like in accordance with the respective heights h1, h2. Thereby, it is possible to provide the junction box 1 for various connectors while the cost is suppressed.

Figure 14A:
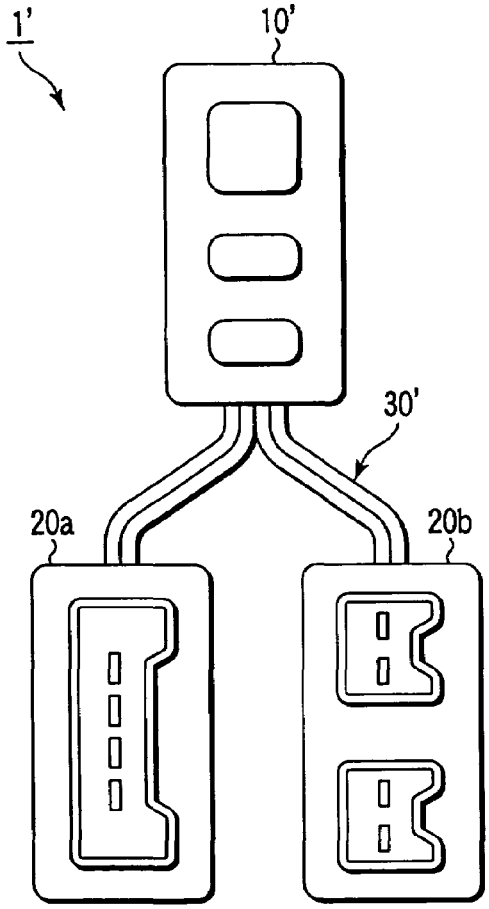
FIGS. 14A and 14B are schematic plan views of an alternative junction box and a schematic plan view of another alternative junction box having an integral structure realized by utilizing the structure of the junction box of FIG. 14A.
Figure 14B:
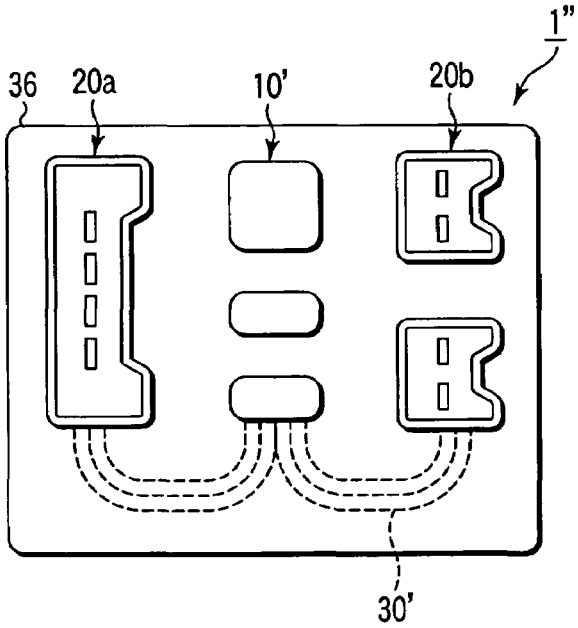

Additionally, the junction box 1 of this example includes a structure in which the junction box main body 10' is connected to the first and second connector portions 20*a,* 20*b* via the cable portion 30' including a plurality of flexible strip FPCs 30*a* to 30*d.* Therefore, as shown in FIG. 14A, of course, the junction box main body 10' and the connector portion 20*a* (20*b*) may be formed with different housings and connected to each other so that the respective housings can freely be moved via the cable portion 30'. Moreover, as shown in FIG. 14B, the junction box main body 10' and connector portion 20*a* (20*b*) are arranged in one housing 36, the cable portion 30' is contained in a connecting state of the junction box main body 10' to the first and second connector portions 20*a,* 20*b* in the housing 36, and a junction box 1" having an integral structure may be formed. When the cable portion 30' having flexibility is used, various types of junction boxes having different shapes can easily be realized at a low cost.

Figure 15A:
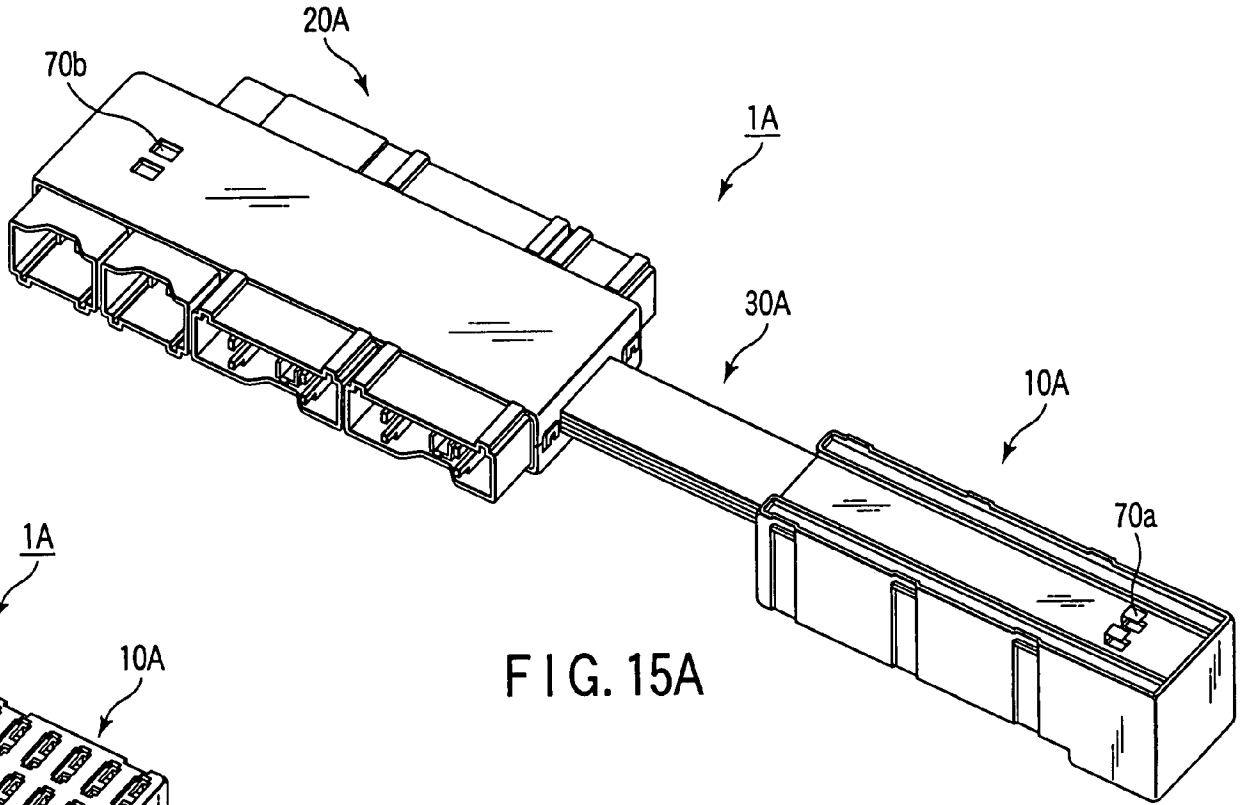
FIGS. 15A and 15B are schematic perspective views of still another embodiment of junction box and connector according to the invention.
Figure 15B:
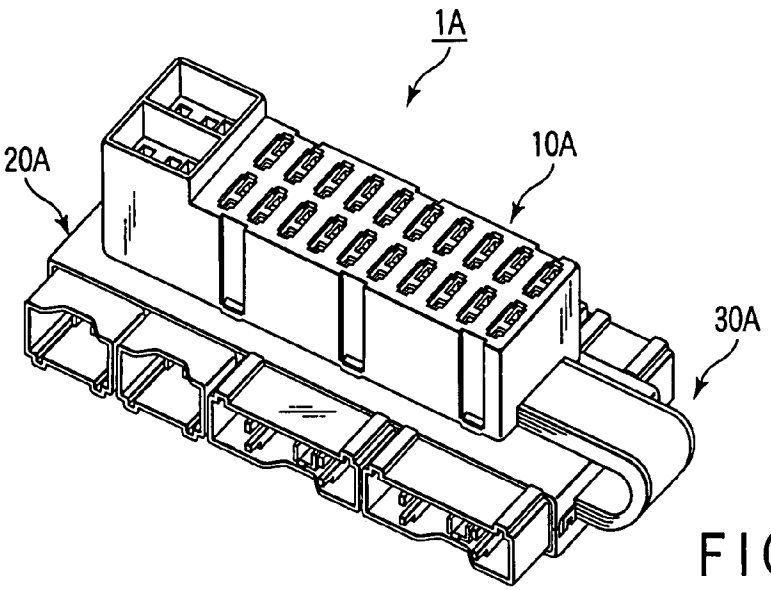

Moreover, not only the integral structure shown in FIG. 14B but also an integral structure shown in FIGS. 15A and 15B may be used.

FIGS. 15A and 15B show perspective views of the appearance of the junction box according to another embodiment of the present invention.

That is, in the integral structure of this example, as shown in FIG. 15A, a junction box 1A in which a junction box main body 10A is connected to a connector portion 20A via a cable portion 30A is integrally fixed via a fixing mechanism 70 (70*a,* 70*b*) disposed in predetermined positions of the junction box main body 10A and connector portion 20A. The fixing mechanism 70 includes hooks 70*a* formed on a part of the lower surface of the junction box main body 10A, and hook engagement portions 70*b* formed in a part of a side part of the connector portion 20A. FIG. 15B shows that the hooks 70*a* formed on the junction box main body 10A are inserted in the hook engagement portions 70*b* formed in the connector portion 20A and both the main body and connector portion are integrally locked/fixed. As the fixing mechanism 70, for example, mechanisms shown in FIG. 16 are considered.

Figure 16A:
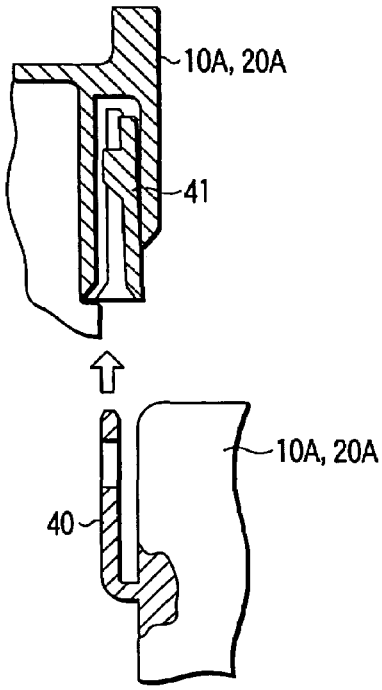
FIGS. 16A through 16D are schematic illustrations of various anchoring mechanisms that can be used for a junction box according to the invention.
Figure 16B:
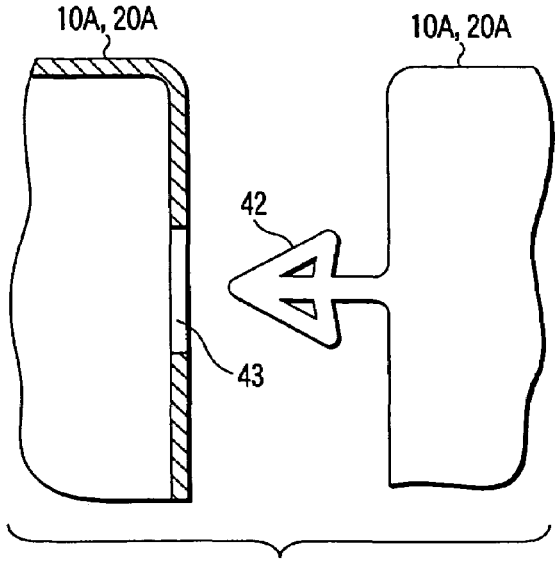

That is, as shown in FIGS. 16A and 16B, a metal bracket 40 is formed on the side surface of the housing or the case portion of either the junction box main body 10A or the connector portion 20A by an insert mold. A bracket engagement portion 41 to be engaged with the metal bracket 40 is formed in the side surface of the other housing. When the bracket is engaged with the bracket engagement portion, the junction box main body 10A and connector portion 20A are fixed by this fixing mechanism.

Moreover, as shown in FIG. 16B, a so-called anchor clip 42 is formed on the side surface of either one housing of the junction box main body 10A or the connector portion 20A by integral molding. An anchor clip fixing portion 43 including a hole to be engaged with the anchor clip 42 is formed in the side surface of the other housing. The anchor clip 42 is inserted in the anchor clip fixing portion 43 so that the junction box main body 10A and connector portion 20A are fixed by this fixing mechanism.

Figure 16C:
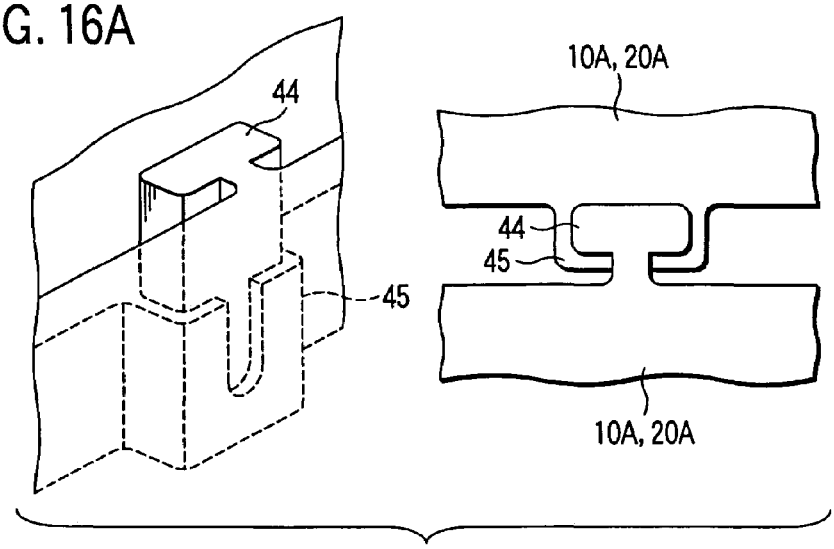

Furthermore, as shown in FIG. 16C, a rib 44 having a T-shaped section is formed on the side surface of one housing of either the junction box main body 10A or the connector portion 20A by the integral molding. A rib fixing portion 45 including a trench structure into which the rib 44 is slid, inserted and engaged is formed in the side surface of the other housing. The rib 44 is inserted into the rib fixing portion 45, and the junction box main body 10A and connector portion 20A are fixed by the fixing mechanism.

Figure 16D:
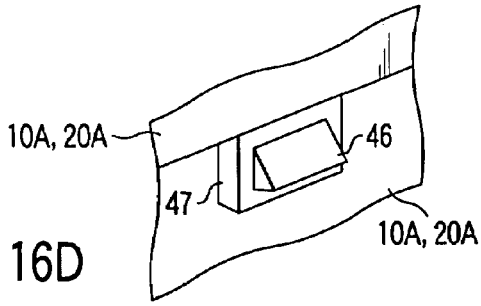

Additionally, as shown in FIG. 16D, a fixing protrusion 46 is formed in any one of the junction box main body 10A and connector portion 20A, and a lock piece 47 to be engaged with the protrusion 46 is formed in the other one. The protrusion is engaged with the piece so that the junction box main body 10A and connector portion 20A are fixed by the fixing mechanism. When these above-described fixing mechanisms 70 are formed beforehand in the housings of the junction box main body 10A and connector portion 20A, the modes of the junction box 1A including an independent structure and integrally coupled structure can easily be selected in a design stage. This makes it possible to enhance a freedom degree of layout of the junction box 1A. Additionally, other various fixing mechanisms for fixing the junction box main body 10A and connector portion 20A are considered, but the description thereof is omitted here. Moreover, needless to say, the above-described fixing mechanism 70 may also be used to fix a plurality of formed connector portions to one another.

Figure 17A:
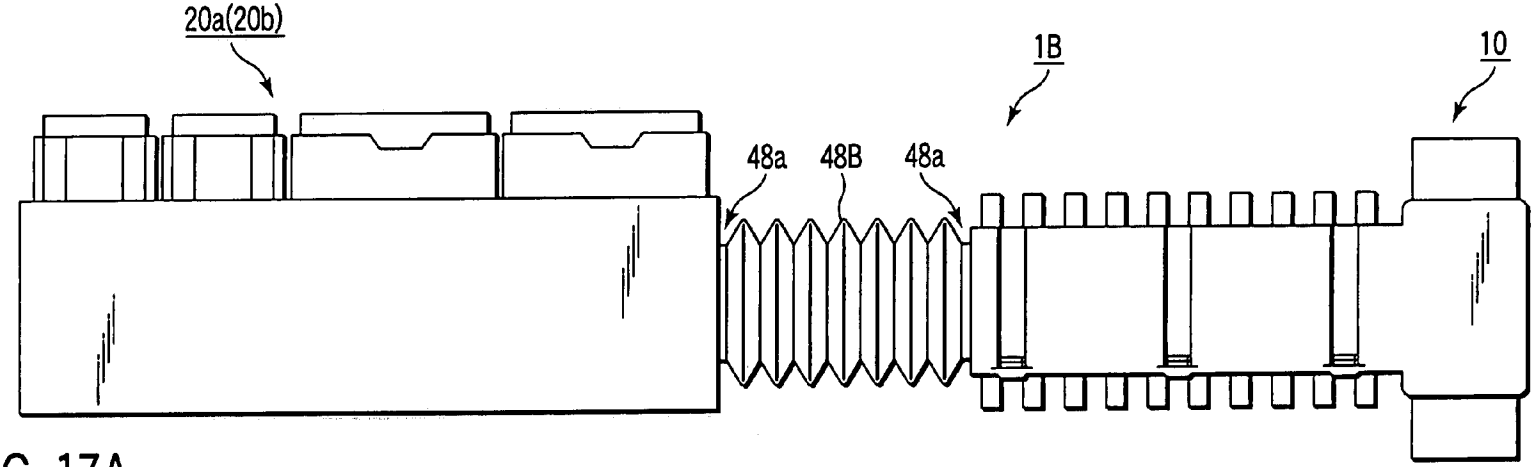
FIGS. 17A and 17B are schematic lateral views of still another embodiment of junction box and connectors according to the invention, showing part thereof in cross section.
Figure 17B:
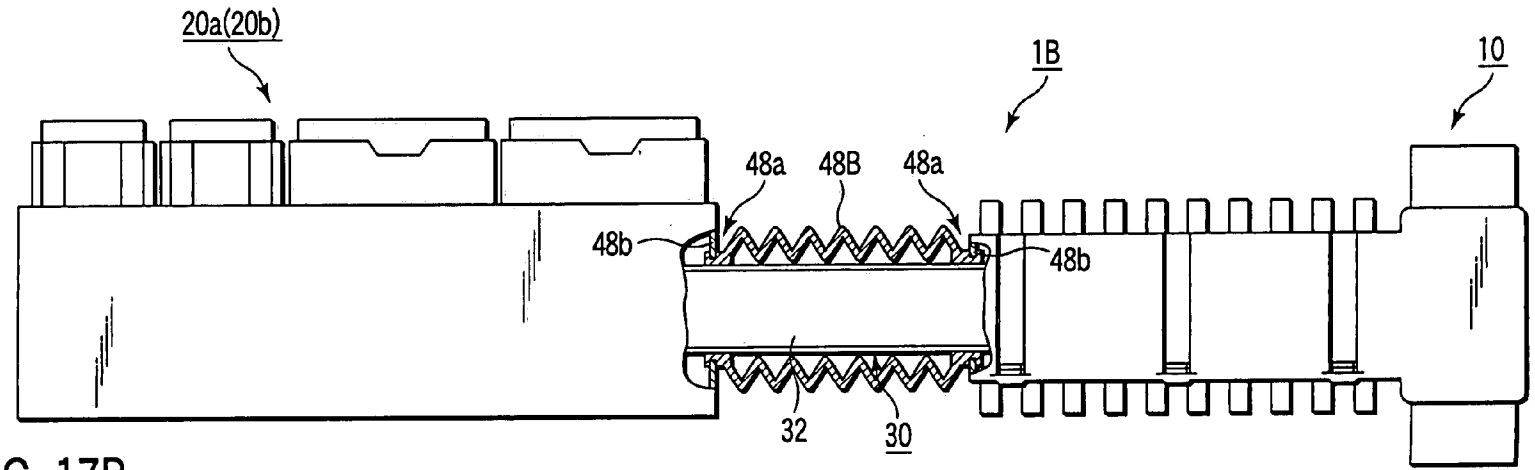

FIGS. 17A and 17B show a side view and partially sectional view showing the junction box according to still another embodiment of the present invention.

As shown in FIG. 17A, a junction box 1B includes a structure in which the junction box main body 10 is connected to the connector portion 20*a* (20*b*) via the cable portion 30 (not shown), and the exposed portion of the cable portion 30 from the junction box main body 10 and connector portion 20*a* (20*b*) is covered with a grommet 48B. As shown in FIG. 17B, the grommet 48B is formed of the above-described materials such as silicon rubber and ethylene propylene rubber (EPDM), has high flexibility and durability, and therefore constitutes a so-called bellows shape. Opposite ends 48*a* of the grommet 48 have engagement structures engaged with opening peripheral edges 48*b* of insertion ports of the cable portion 30 into the junction box main body 10 and connector portion 20*a* (20*b*), and are attached/fixed to the junction box main body 10 and connector portion 20*a* (20*b*). The grommet 48B attached in this manner can effectively prevent the moisture and dust from entering the junction box main body 10 and connector portion 20*a* (20*b*) as described above, and can effectively protect the circuit portions 32 of the respective FPCs constituting the cable portion 30 in the exposed state between the main body and portion from damage and breakage. Therefore, the durability of the junction box 1B can be enhanced.

Figure 18A:
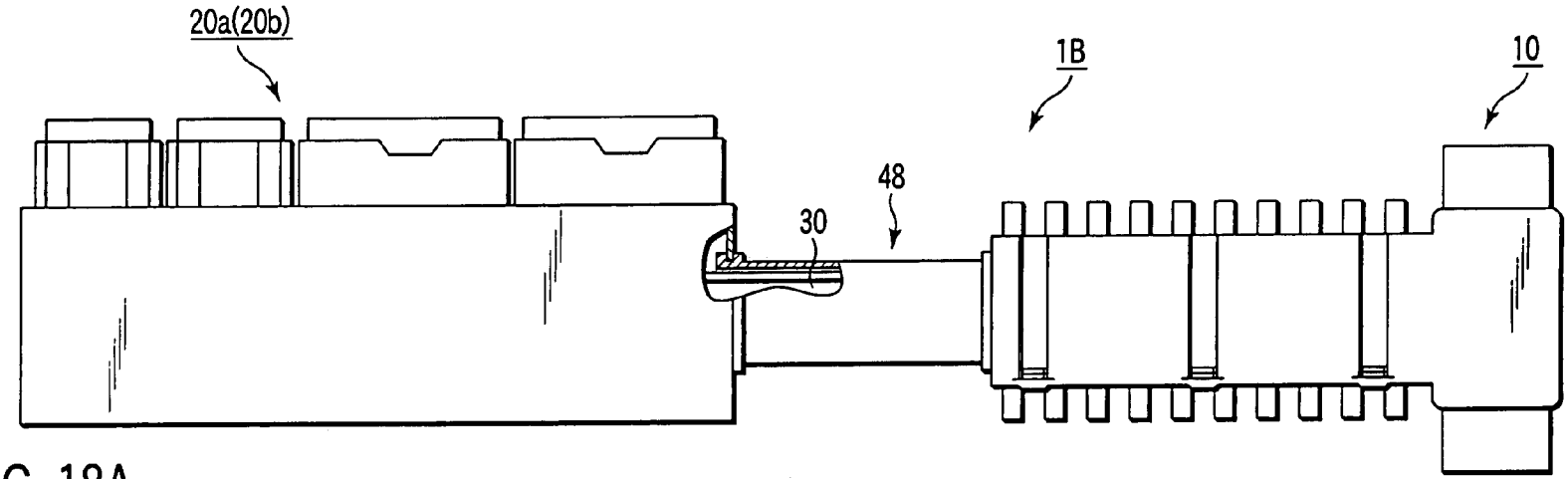
FIGS. 18A and 18B are schematic lateral views, showing grommets having different patterns.
Figure 18B:
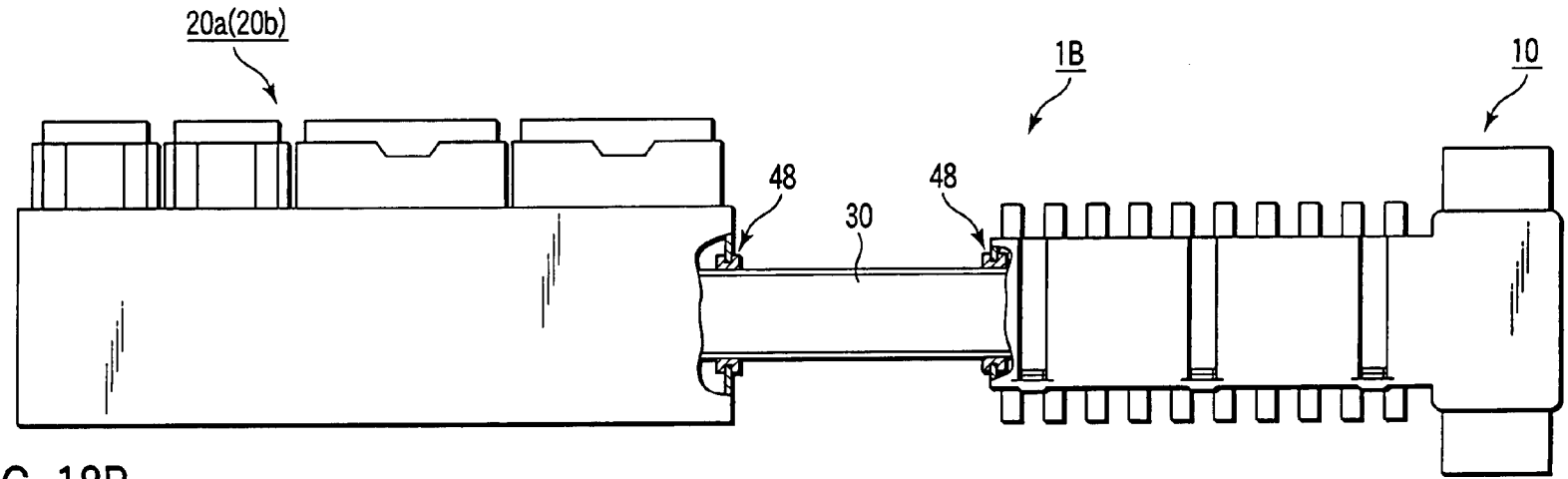

Additionally, for the grommet 48B, instead of the bellows shape, for example, a tubular shape including the above-described square section (rectangular section), or a cylindrical shape including a circular shape may be used as shown in FIG. 18A. Moreover, when it is unnecessary to cover or protect the exposed portion of the cable portion 30, as shown in FIG. 18B, the grommet 48 engaged with the opening peripheral edges 48*b* of the insertion ports of the junction box main body 10 and connector portion 20*a* (20*b*) and constituted as a packing for effectively closing the insertion ports and preventing the entrance of the moisture may be used to constitute the junction box 1B.

Figure 19A:
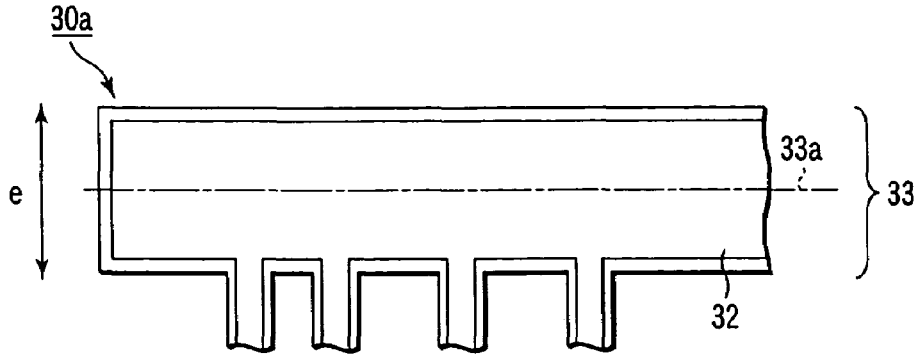
FIGS. 19A through 19C are schematic illustrations of cable portions having different structures.
Figure 19B:
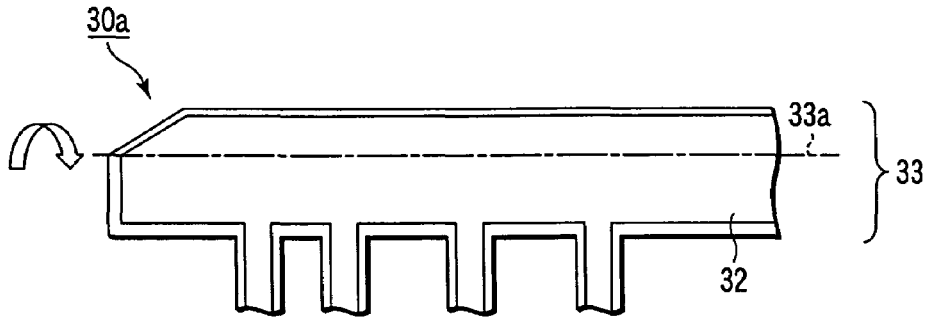
Figure 19C:
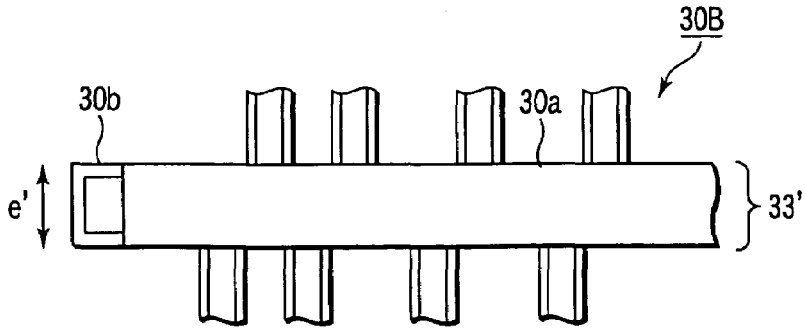

Additionally, as the above-described cable portion 30, as shown in FIGS. 19A to 19C, a cable portion 30B may also be used including a structure in which the strip portions 33 are folded back and superimposed in order to shorten a circuit width e of the circuit portion 32. In this case, for example, as shown in FIG. 19A, a center line 33*a* is determined which connects the vicinity of the center of the short direction of the strip portion 33 of the FPC 30*a* constituting the cable portion 30B in the longitudinal direction. As shown in FIG. 19B, the strip portion 33 of the FPC 30*a* is bent and superimposed along the center line 33*a* so that the surfaces with the circuit portions 32 (or the surfaces with the base film 31) formed thereon are disposed opposite to each other. As shown in FIG. 19C, the FPC 30*a* is superimposed onto the FPC 30*b* with a strip portion 33' formed beforehand thereon with a circuit width which meets a circuit width e' of the folded FPC 30*a,* and the cable portion 30B is formed. When the entire circuit width of the cable portion 30B is reduced in this manner, the entire height and width of the junction box 1 applying this cable portion 30B can be suppressed, and the junction box 1 can efficiently be miniaturized. Moreover, the FPC 30*a* having the folded strip portion 33 is set beforehand, for example, in a power supply circuit (power distribution circuit). As a result, a circuit area can be enlarged. Therefore, the FPC which has high radiating properties and Whose circuit width can be adapted to the circuit width of another FPC or shortened can be used as the power distribution circuit.

Figure 20A:
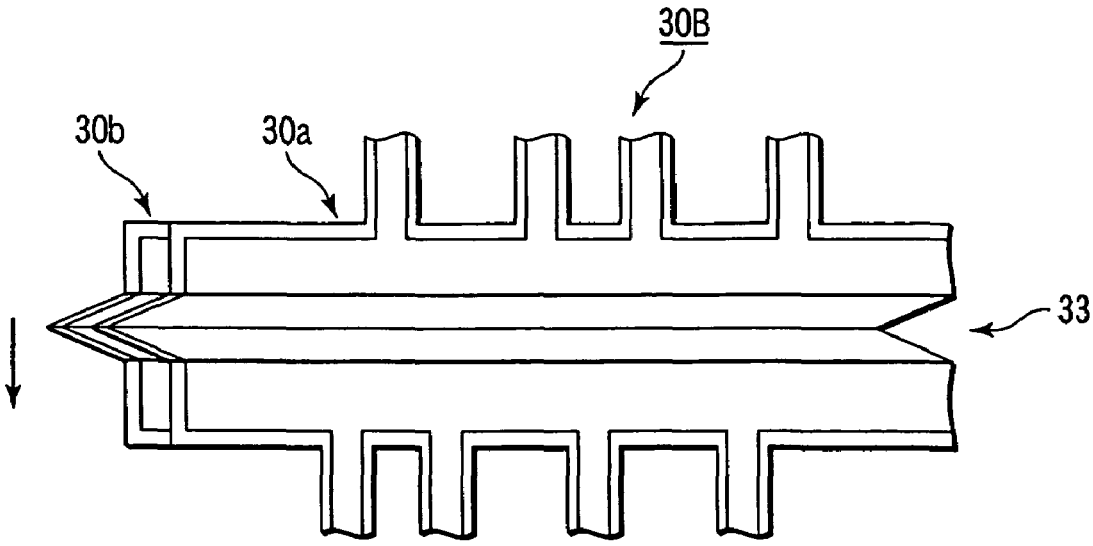
FIGS. 20A and 20B are schematic illustrations of cable portions having still different structures.
Figure 20B:
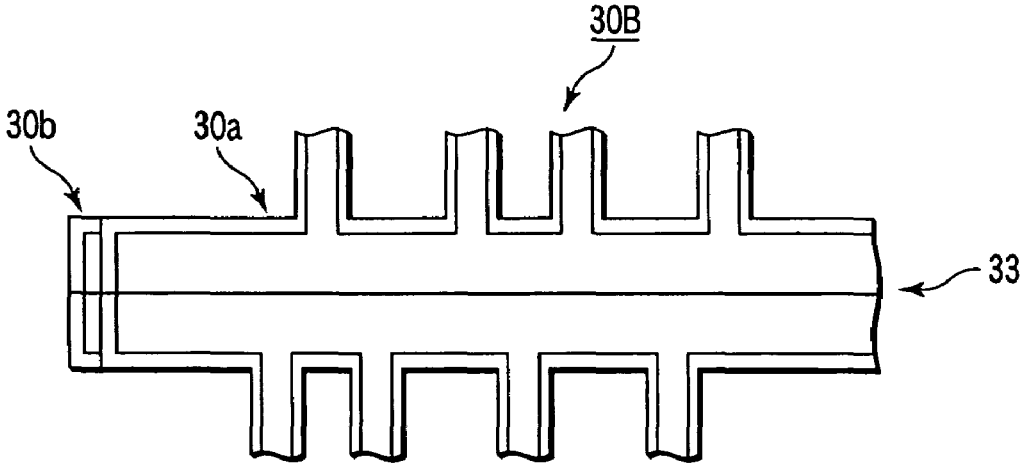

Moreover, as shown in FIG. 20A, the FPCs 30*a,* 30*b* constituting the cable portion 30B are first superimposed upon each other. Thereafter, the strip portions 33 of the respective FPCs 30*a,* 30*b* are folded so that the center line 33*a* of each strip portion 33 is positioned in the vertical direction with respect to the circuit formed surface of the circuit portion 32 (so that the center line is a bottom side of a portion folded in a trough shape or an apex of a portion folded in a mountain shape). As shown in FIG. 20B, a part of the folded strip portion 33 is further folded, and the cable portion 30B having a short circuit width may also be realized.

Figure 21A:
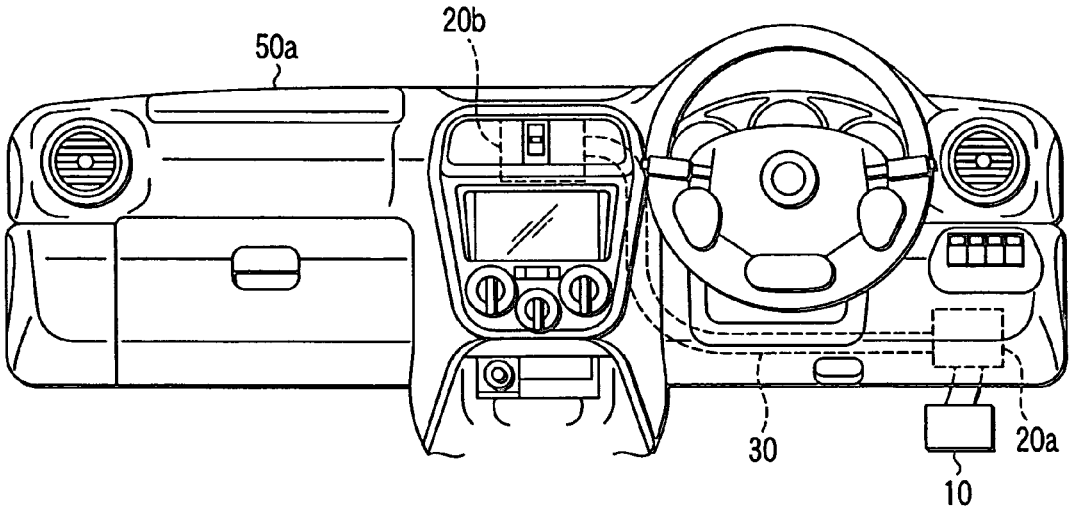
FIGS. 21A and 21B are schematic illustrations of instrument panels of automobiles provided with an embodiment of junction box and connector according to the invention.

Additionally, the junction box 1 of the present invention is used in a mode in which the junction box main body 10 is connected to a plurality of connector portions 20 in independent states via the cable portion 30. In this case, for example, an application method shown, for example, in FIGS. 21A and 21B can be realized. That is, FIGS. 21A and 21B show diagrams of a state in which the junction box 1 is disposed in an instrument panel of a car, FIG. 21A shows the instrument panel for use in a so-called right-side steering wheel mounted car, and FIG. 21B shows the instrument panel for use in a so-called left-side steering wheel mounted car.

Figure 21B:
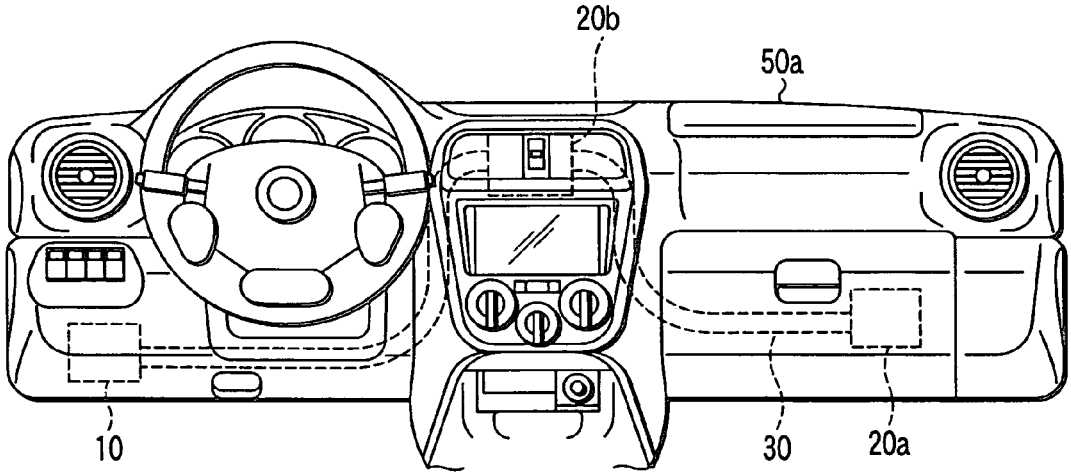
Figure 28:
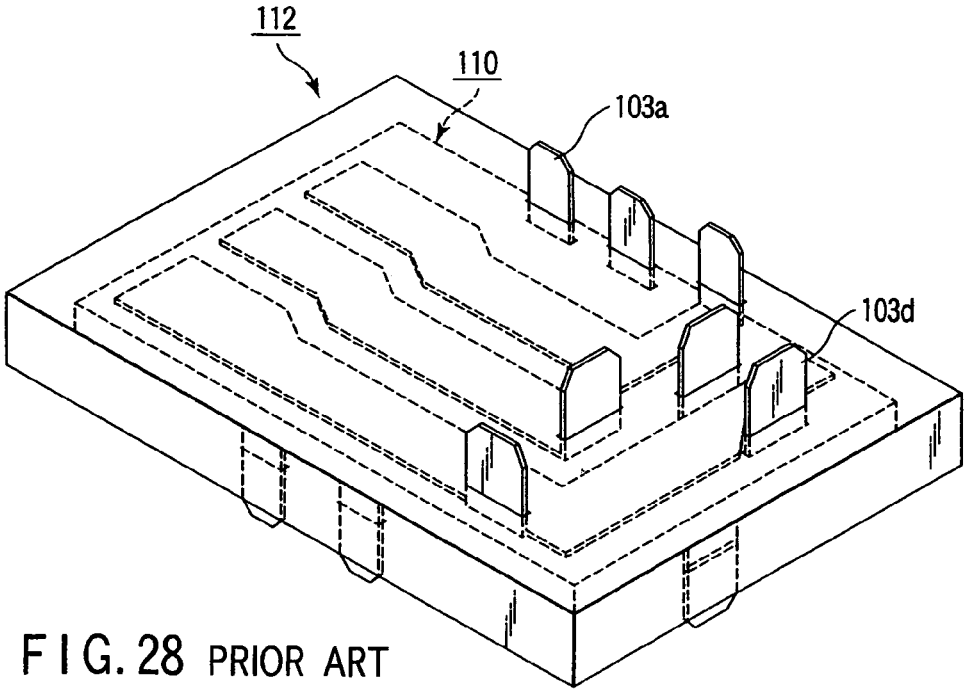
FIG. 28 PRIOR ART
FIG. 28 is a schematic perspective view of a known junction box containing the wiring circuit having a multilayed structure.

For example, with an instrument panel 50*a* of the right-side steering wheel mounted car shown in FIG. 28A, and an instrument panel 50*b* of a left-side steering wheel mounted car shown in FIG. 21B, the arrangement position of the junction box main body 10 is set in the vicinity of a steering wheel. The first connector portion 20*a* is disposed on the right as facing the instrument panel 50*a* or 50*b* and the second connector portion 20*b* is disposed in the middle of the instrument panel 50*a* or 50*b*. Then, the arrangement position of the connector portion 20*a* (20*b*) can be set in common to the right and left side steering wheel mounted cars. Therefore, a common harness can be used, the number of components can be decreased, and the cost can be reduced. As described above, according to the arrangement structure using the junction box 1, the attachment positions of the junction box main body 10 and connector portion 20*a* (20*b*) can easily be changed, and the arrangement positions can freely be determined. Therefore, a large design change is not accompanied. Even in this case, it is possible to enhance the freedom degree of layout and broaden wiring design, and the like.

Figure 22A:
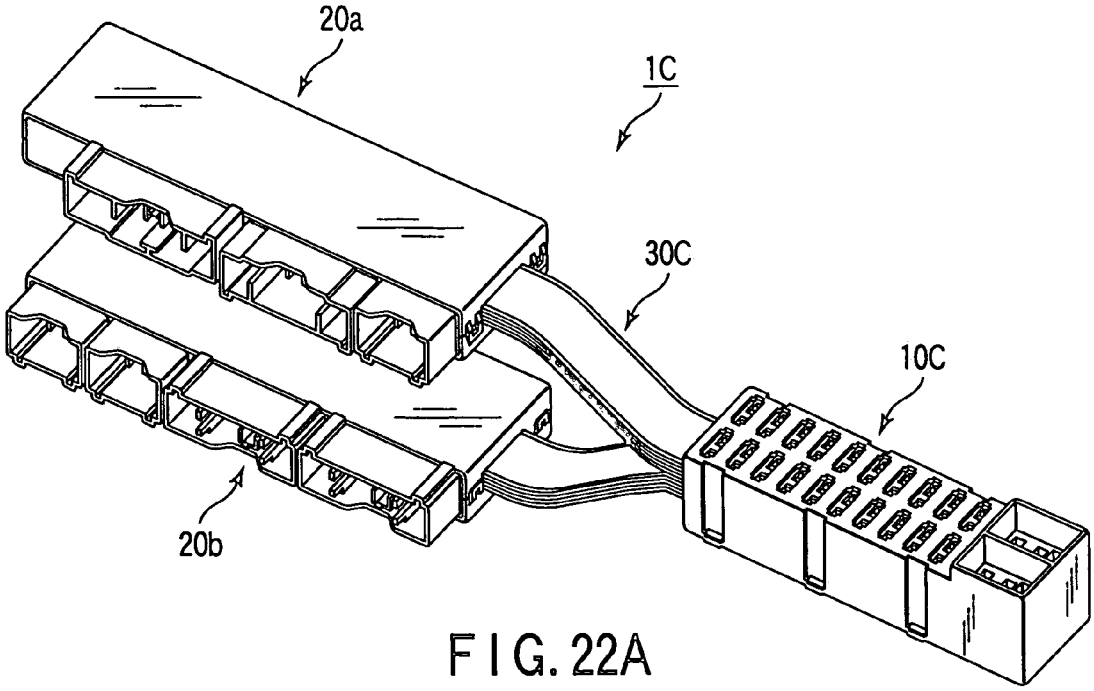
FIGS. 22A and 22B are schematic perspective views of still other embodiments of junction box and connector according to the invention.
Figure 22B:
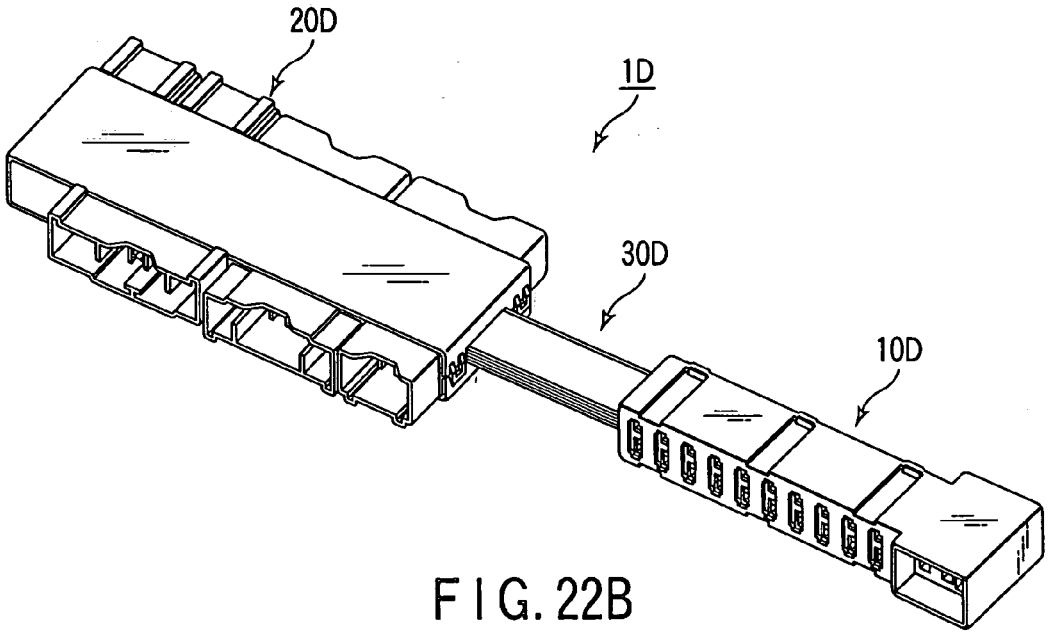
Figure 23:
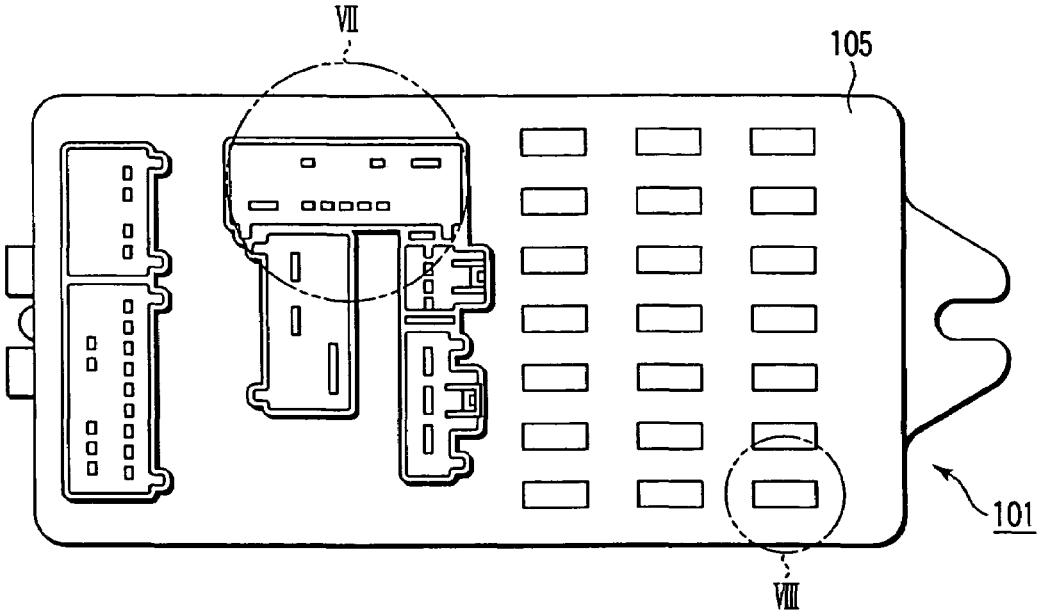
FIG. 23 PRIOR ART
FIG. 23 is a schematic plan view of a known junction box.
Figure 24:
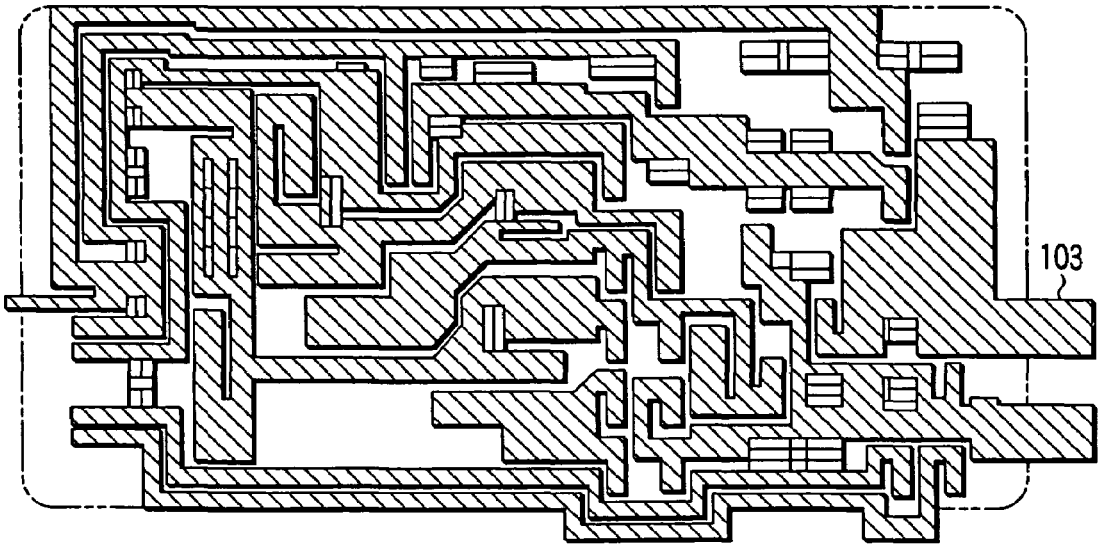
FIG. 24 PRIOR ART
FIG. 24 is a schematic plan view of a bus bar stored in the junction box of FIG. 23.
Figure 25:
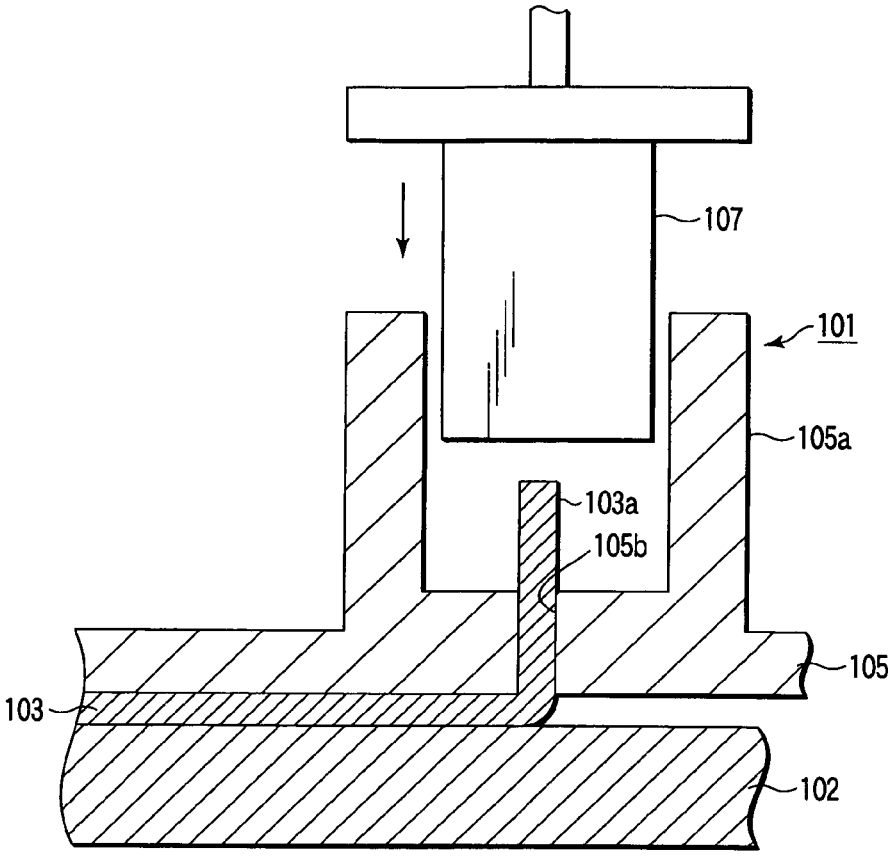
FIG. 25 PRIOR ART
FIG. 25 is a schematic cross sectional view of a portion VII in FIG. 23.
Figure 27:
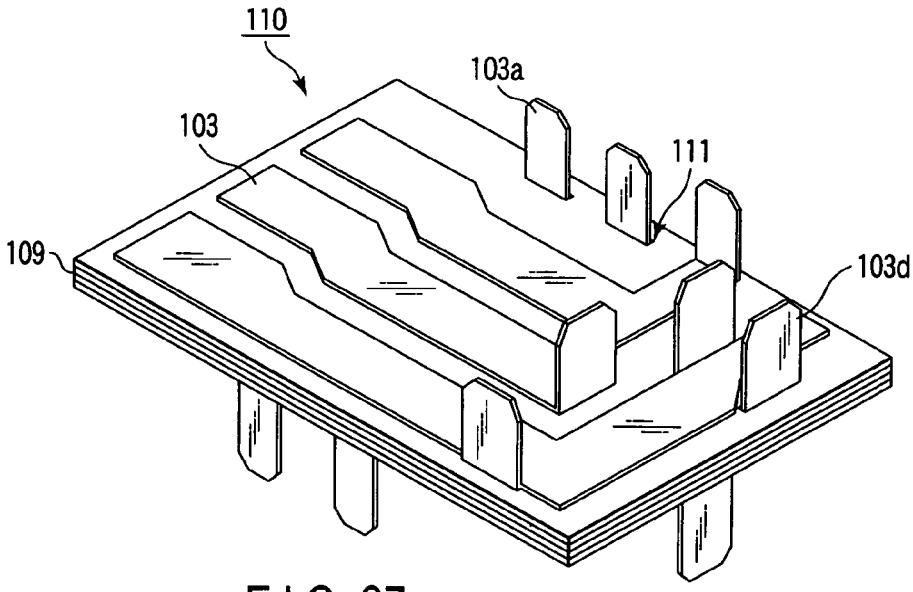
FIG. 27 PRIOR ART
FIG. 27 is a schematic perspective view of a known wiring circuit having a multilayed structure.
Figure 26:
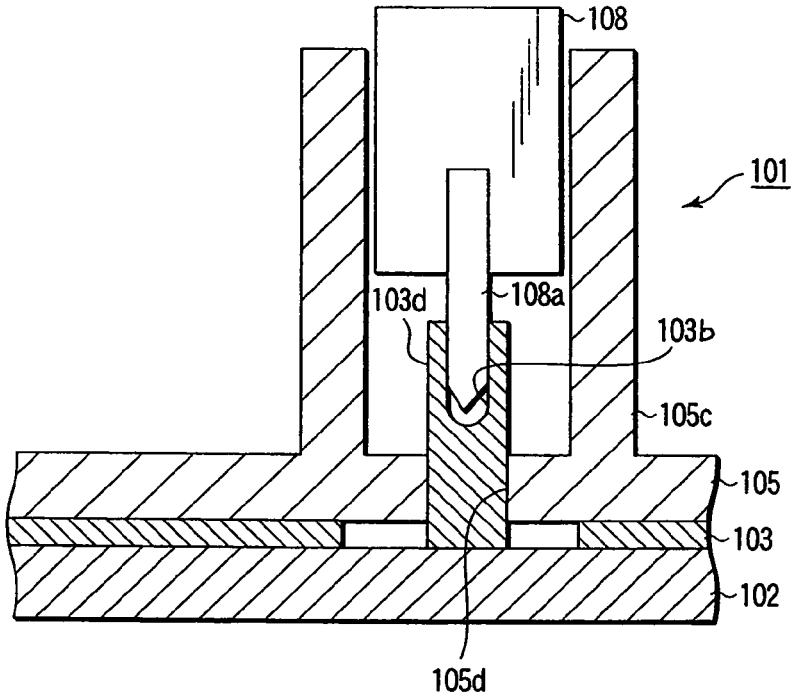
FIG. 26 PRIOR ART
FIG. 26 is a schematic cross sectional view of part VIII in FIG. 23.

Additionally, in the above-described embodiment, several examples of the mode of the junction box 1 have been described, but the present invention is not limited to these examples. Examples of the mode include various modes of junction boxes such as: a junction box 1C constituted of a combination of a junction box main body 10C, connector portion 20*a* (20*b*) and cable portion 30C as shown in FIG. 22A; and a junction box 1D constituted of a combination of a junction box main body 10D, connector portion 20D and cable portion 30D as shown in FIG. 22B.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A junction box comprising:

a junction box main body to which an electric component to be connected is attached;

a connector portion which is spaced in a longitudinal direction from said junction box main body, and which connects a connector of an outer wiring circuit and is formed separately from said junction box main body; and a longitudinally extending cable portion which is constituted of a flexible printed circuit with a circuit portion including a conductor pattern formed on an insulating film, and electrically connects the junction box main body to said connector portion, wherein said flexible printed circuit includes a strip portion for linking said junction box main body and said connector portion and a terminal connecting portion extending transversally from a lateral edge of said strip portion at positions to be fitted to said junction box main body and said connector portion, said junction box main body includes a junction box housing provided with a part fitting port for fitting said electric component and a plate-shaped first connecting terminal to be contained in said junction box housing so as to be connected to the terminal connecting portion of said flexible printed circuit and further to said electric component, said connector portion including a connector housing for receiving said connector of said outer wiring circuit and a second connecting terminal to be connected to the terminal connecting portion of said flexible printed circuit and contained in the connector housing so as to be connected to said connector of said outer wiring circuit, and said strip portion of said flexible printed circuit is bent in a transversal direction along said longitudinal direction.

2. The junction box according to claim 1, wherein said first and second connecting terminals are connected to said terminal connecting section by resistance welding, ultrasonic wave welding, last welding or soldering.

3. The junction box according to claim 1, wherein a plurality of terminal connecting portions are formed on said flexible printed circuit and extended form the lateral edges of said strip portion.

4. The junction box according to claim 1, wherein said plurality of flexible printed circuits of said cable portion are superimposed upon one another in a non-bonded state so that said terminal connecting portions of the respective flexible printed circuits are arranged in positions with the first connecting terminal of said junction box main body and the second connecting terminal of said connector portion arranged therein.

5. The junction box according to claim 1, wherein the connecting portion of said first and second connecting terminals and said terminal connecting portion is sealed by a molded piece of resin.

6. The junction box according to claim 3, wherein said flexible printed circuit is formed by bending at least one of the terminal connecting portions formed at the respective lateral edges of said strip portion toward the opposite lateral edge.

7. The junction box according to claim 1, wherein the circuit portion of said flexible printed circuit having said strip portion bent in a transversal direction along a longitudinal direction is a power distribution circuit.

8. The junction box according to claim 1, wherein said junction box housing is provided with a lance mechanism for rigidly securing said first connecting terminal to the inside.

9. The junction box according to claim 1, wherein said connector housing is provided with a lance mechanism for rigidly securing said second connecting terminal to the inside.

10. The junction box according to claim 1, wherein said connector portion is removably fitted to said connector housing;

said connector portion further comprising a case portion for containing at least a part of said flexible printed circuit in the inside.

* * * * *